US012378842B1

(12) United States Patent
Clark et al.

(10) Patent No.: US 12,378,842 B1
(45) Date of Patent: Aug. 5, 2025

(54) EXPANDABLE POLYMER GROUT FOR SEALING SUBTERRANEAN FORMATIONS

(71) Applicant: Chevron U.S.A. Inc., San Ramon, CA (US)

(72) Inventors: Peter James Clark, The Woodlands, TX (US); Michael James Fuller, Cypress, TX (US); Douglas Cory Arceneaux, Katy, TX (US); William Dale Wood, Montgomery, TX (US); John Bryan Trenery, Jr., Sugar Land, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/431,670

(22) Filed: Feb. 2, 2024

(51) Int. Cl.
*E21B 33/138* (2006.01)

(52) U.S. Cl.
CPC ..... *E21B 33/138* (2013.01)

(58) Field of Classification Search
None
See application file for complete search history.

(56) References Cited

U.S. PATENT DOCUMENTS

| | | | | |
|---|---|---|---|---|
| 2002/0023754 | A1* | 2/2002 | Buytaert | E21B 33/138 166/50 |
| 2018/0274333 | A1* | 9/2018 | Gibb | E21B 33/13 |
| 2020/0011151 | A1 | 1/2020 | Toews et al. | |
| 2022/0034187 | A1* | 2/2022 | Noui-Mehidi | E21B 33/127 |
| 2022/0282590 | A1* | 9/2022 | Fripp | E21B 33/1277 |
| 2024/0026749 | A1* | 1/2024 | Benet | C09K 8/44 |

FOREIGN PATENT DOCUMENTS

WO WO 2022/132552 * 6/2022

* cited by examiner

*Primary Examiner* — Andrew Sue-Ako
(74) *Attorney, Agent, or Firm* — King & Spalding LLP

(57) ABSTRACT

An open hole formation surface within a wellbore of a well system is sealed with a polymer seal. A deployment system is inserted into the wellbore to the location of the open hole formation surface. The open hole formation surface may be located at the bottom of the wellbore or at an interval between two casing strings. The deployment system delivers an expandable polymer grout system to the location of the open hole formation surface. The expandable polymer grout system cures to form the polymer seal on the open hole formation surface.

16 Claims, 11 Drawing Sheets

EXPANDABLE POLYMER GROUT FOR SEALING SUBTERRANEAN FORMATIONS

TECHNICAL FIELD

The present application relates to methods of deploying expandable polymeric materials for sealing exposed subterranean formations in a wellbore or other subterranean space.

BACKGROUND

In many types of wells, as a wellbore is drilled, tubular casing is placed in the wellbore to seal the wellbore from the surrounding formation in which the wellbore is being drilled. The casing can be used to prevent fluids from leaking from the formation into the wellbore. The casing also can be used to prevent fluids from leaking from the wellbore into the formation. Furthermore, the casing can be useful for maintaining the integrity of the formation face along the wellbore. In some instances, the casing is used to withstand external pressures on the wellbore from the formation or internal pressures from fluids within the wellbore pushing outward toward the formation.

Casing is typically inserted into a wellbore in tubular sections. In order to completely seal the wellbore, the joints between the tubular sections of casing are typically sealed. Additionally, the ends of the tubular sections are sealed. It is common to insert multiple strings of casing sections into a wellbore as the well is drilled deeper. The strings of casing are placed into the well one inside the other to seal a wellbore as it is drilled. As such, the diameter of the wellbore becomes progressively smaller as each new string of casing is inserted inside a string of casing that is already present in the wellbore.

The shape of the tubular sections of casing and the narrowing diameter of the wellbore as the well is drilled deeper present challenges in properly sealing the wellbore. As one example, if a secondary wellbore is drilled that branches from a primary wellbore, the junction where the two wellbores intersect presents geometries that are not completely cylindrical and, therefore, are challenging to seal with tubular sections of casing. As another example, in a high-angle wellbore that branches from a vertical wellbore, it can be difficult to fit a tubular section of casing into the high-angle wellbore to completely seal the high-angle wellbore. As yet another example, the bottom interval of a wellbore may have open sections of the formation face that are difficult to seal with a tubular section of casing.

In view of these challenges with conventional tubular sections of casing, it would be beneficial to have alternate techniques for sealing a wellbore. In particular, techniques that provide flexibility and allow for sealing complex geometries of a subterranean formation face in a wellbore would be beneficial.

SUMMARY

This summary is provided to introduce various concepts in a simplified form that are further described below in the detailed description. This summary is not intended to identify required or essential features of the claimed subject matter nor is the summary intended to limit the scope of the claimed subject matter.

One example embodiment provides a method for placing a polymer seal in a well system. The method can comprise: (a) placing a primary barrier across a primary casing in a primary wellbore; (b) placing a secondary barrier across a secondary casing in a secondary wellbore; (c) inserting a deployment system to a junction in the well system, the junction formed by an intersection of the primary wellbore and the secondary wellbore, wherein the junction is located above the primary barrier and the secondary barrier and the junction comprises an open hole formation surface; (d) delivering with the deployment system an expandable polymer grout system to the junction; retracting the deployment system from the junction; and (e) allowing the expandable polymer grout system to cure to form the polymer seal at the junction.

Another example embodiment provides another method for placing a polymer seal in a well system. The method can comprise: (a) placing a primary barrier across a primary casing in a primary wellbore; (b) placing a secondary barrier across a secondary casing in a secondary wellbore, wherein the primary wellbore and the secondary wellbore intersect and are aligned at a junction, wherein the junction is located adjacent to the primary barrier and the secondary barrier; (c) inserting a deployment system to the junction in the well system, wherein the junction comprises an open hole formation surface; (d) delivering with the deployment system an expandable polymer grout system to the junction; (e) retracting the deployment system from the junction; and (f) allowing the expandable polymer grout system to cure to form the polymer seal at the junction.

Another example embodiment provides yet another method for placing a polymer seal in a well system. The method can comprise: (a) inserting a deployment system to a target location within a wellbore in the well system, the target location located at a base of the wellbore, wherein the target location comprises an open hole formation surface; (b) delivering with the deployment system an expandable polymer grout system to the target location; (c) retracting the deployment system from the target location; and (d) allowing the expandable polymer grout system to cure to form the polymer seal at the junction.

DEFINITIONS

Figure 1A:
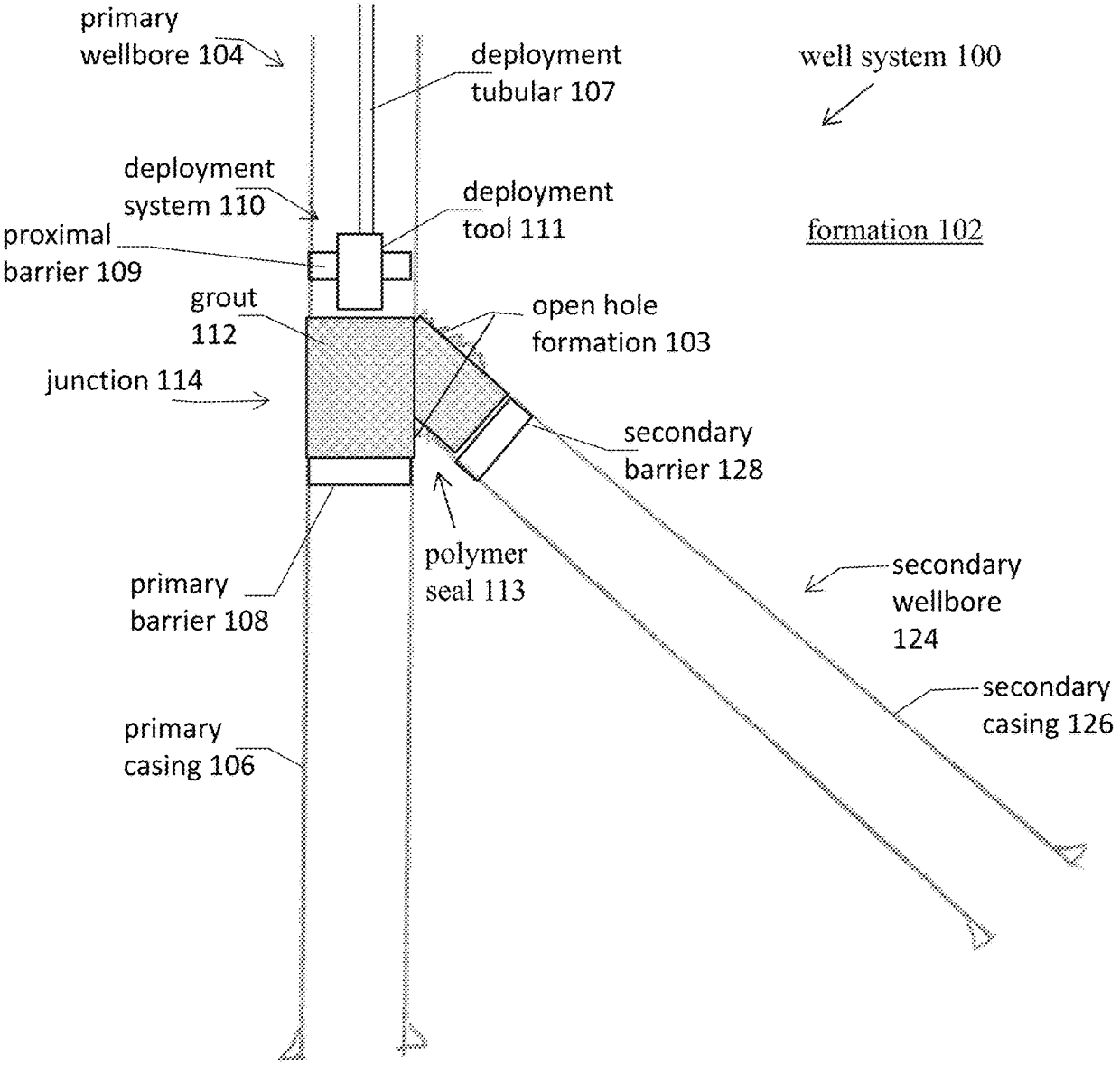
FIG. 1A is a sectional view drawing of a well system in which a polymer seal is placed at a junction of two wells in accordance with the example embodiments described herein.

To define more clearly the terms used herein, the following definitions are provided. Unless otherwise indicated, the following definitions are applicable to this disclosure. If a term is used in this disclosure but is not specifically defined herein, the definition from the IUPAC Compendium of Chemical Terminology can be applied, as long as that definition does not conflict with any other disclosure or definition applied herein or render indefinite or non-enabled any claim to which that definition is applied. To the extent that any definition or usage provided by any document incorporated herein by reference conflicts with the definition or usage provided herein, the definition or usage provided herein controls.

While compositions and methods are described in terms of "comprising" various components or steps, the compositions and methods can also "consist essentially of" or "consist of" the various components or steps, unless stated otherwise.

The terms "a," "an," and "the" are intended to include plural alternatives, e.g., at least one. The terms "including", "with", and "having", as used herein, are defined as comprising (i.e., open language), unless specified otherwise.

Various numerical ranges are disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. For example, all numerical end points of ranges disclosed herein are approximate, unless excluded by proviso.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means ±20% of the stated value, ±15% of the stated value, ±10% of the stated value, ±5% of the stated value, ±3% of the stated value, or ±1% of the stated value.

The term "polymer seal" is used herein to refer to a polymer barrier placed along a formation face in a wellbore, the polymer barrier being created by the expandable polymer grout systems described herein, and positioned at a target location(s) along the length of one or more wellbores in a well system. The polymer seal may be placed along open hole sections, in annular areas, and/or within combinations thereof in a wellbore. The polymer seals may be utilized for permanent sealing operations along a formation face in a wellbore. The polymer seals also may be utilized for remedial or temporary sealing of a formation face, such as for formation stabilization or fluid control, sand control, sealing off lost circulation zones, sealing off water flow zones, and for structural wellbore stabilization, such as during drilling or completion operations.

As referred to herein, the term "wellbore" includes the borehole and any tubulars and compositions positioned therein.

As referred to herein, the term "coupled" can refer to two components that are in direct contact or directly attached to one another as well as two components that are joined or attached by a third component.

DESCRIPTION OF THE EXAMPLE EMBODIMENTS

Expandable polymer grout systems and methods are disclosed herein that are useful for sealing a portion or entirety of a formation face within a wellbore. The expandable polymer grout systems and methods described herein are particularly useful for well systems and wellbore intervals having complex geometries in which it is difficult to place a tubular section of casing. The expandable polymer grout systems described herein can be used to seal intervals of a formation face in which a tubular section of casing cannot easily be placed. The systems and methods described herein can be used in a variety of wells, including but not limited to subsea wells, onshore wells, hydrocarbon wells, and geothermal wells. Furthermore, the systems and methods described herein can be applied to seal other underground spaces, such as caverns, for storing a variety of materials, including hydrocarbons, hydrogen, carbon dioxide, and water.

An existing approach to sealing complex geometries in a wellbore where any tubular cannot easily be placed is to apply cement along the formation face at the target location as a substitute for the tubular. However, cement can be porous and brittle, making it inadequate for achieving a durable seal along a formation face in a wellbore. The efficacy of cement can be challenging when it is used to seal a complex geometry in a wellbore without any casing to provide additional support. Further, the design of an appropriate sealing volume of cement in an uncertain void space and geometry further challenges the cement efficacy. In contrast to cement, the expandable polymer grout described herein can bond more effectively to a formation face. After curing, the expandable polymer grout can be more flexible and resilient than cement, thereby providing greater durability in the wellbore. Accordingly, expandable polymer grout can provide a more effective seal along a formation face in a wellbore from expansion into unanticipated voids.

Expandable Polymer Grout System

As explained in greater detail below, the expandable polymer grout systems described herein can comprise an isocyanate component and an organic polyol component that react to form the expandable polymer grout. In certain embodiments, the expandable polymer grout systems are deployed with a blowing agent to a downhole location, for example, in a wellbore. The blowing agents can be physical or chemical blowing agents. Blowing agents can be, for example, inert liquids that have low boiling points and non-reactivity to isocyanate groups. These blowing agents are evaporated during exothermic reaction of polyurethane to generate blowing gas. In certain embodiments, the components of the expandable polymer grout system are in liquid or solution form (injectable during deployment) and will set up into an expanded state once adequately mixed together and placed at a target location along a formation face in a wellbore.

The expandable polymer grout system according to the embodiments herein can be optimized in order to achieve various performance properties to ensure successful application through the example methods described herein. In particular, the systems and methods can be varied to optimize permeability, density volume of expansion, expansion percentage, curing time and water sensitivity.

In certain embodiments, the system may, under wellbore temperatures and pressures, render an expanded and cured solid polymer that will seal the formation face and all associated interfaces of the wellbore. In certain embodiments, the seal is gas-tight, comprising properties of minimal fluid-loss and short transition time (<30-45 min). In certain embodiments, the cured expanded polymer grout system provides minimal shrinkage over years downhole in order to maintain the seal along the formation face.

Depending on the level of expansion (due to action of the blowing agents in the system), the resultant polymer seal may vary significantly in the ultimate density (known as the free-rise density). Conversely, the hydrostatic pressure and applied surface pressure during placement may inhibit some expansion of the grout leading to higher cured densities. In certain embodiments, the expandable polymer grout system described herein yields polymer seals that range in free rise density from about 2 to about 62 $lbm/ft^3$. In certain embodiments, the expandable polymeric grout system has a confined density in the range of about 15 to about 40 $lbm/ft^3$. In certain embodiments, the volume of the reaction product (i.e., the volume of the polymer seal or the expanded and cured polymer grout system) is about 2 to 13 times the initial combined volume of the liquid precursor components of the polymer grout system before reacting. In certain embodiments, the expandable polyurethane grout system has a specific gravity after expansion in the range of about 0.05 to about 0.6, about 0.09 to about 0.53, about 0.09 to about 0.30, or about 0.09 to about 0.15.

Differences in the expandable polymer grout system may lead to differences in the curing time. Practitioners in polyurethane chemistry often report several types of time for each system (from the "cream time", at which the solution color becomes turbid, through the "rise time"); and differences in the system, specifically the selection and concentrations of blowing agent and catalysts, can lead to differences in curing time. In certain embodiments, the expandable polymer grout system is optimized with regards to curing times to ensure that the expansion and setting does not occur until the full volume of blended components are placed at the target location along a formation face.

Depending on the components of the expandable polymer grout system, the system may have higher or lower sensitivity to water that may be experienced downhole (including in the formation matrix itself). In certain embodiments, the expandable polymer grout system is designed to minimize sensitivity to downhole water (which would lead to higher expansion and lower final density).

In certain embodiments, the expandable polymer grout system, or method of injecting the system, is designed to minimize sensitivity to any fluids that may reside in the wellbore or formation porosity prior to injection. In certain embodiments, the methods described herein involve the injection of either a fluid or gas pre-flush to displace near wellbore fluids deeper into the formation, up the annulus, or up the wellbore, prior to injection of the polyurethane precursor blend.

Generally, the expandable polymer grout system comprises a polyurethane. The polyurethane is formed from the reaction of an isocyanate component and an organic polyol component. In certain embodiments, the reaction of the isocyanate component and the organic polyol component proceeds by combining the components in the presence of a blowing agent and, optionally, a catalyst, at a temperature of at least about 15° C. or about 20° C. to form the expandable polymer grout. In certain embodiments, the reaction of the isocyanate component and the organic polyol component proceeds by combining the components in the presence of a blowing agent and, optionally, a catalyst, at a temperature in the range of about 15° C. to about 60° C., or about 20° C. to about 40° C.

The term "polyurethane", as referred to herein, is not limited to those polymers which include only urethane or polyurethane linkages. In certain embodiments, the polyurethane polymers may also include allophanate, carbodiimide, uretidinedione, and other linkages in addition to urethane linkages.

In one embodiment, an expandable polymer grout system comprises the reaction product of: (i) an isocyanate component comprising one or more isocyanate compounds; and (ii) an organic polyol component comprising one or more organic polyol compounds; in the presence of (iii) one or more blowing agents. In certain embodiments, the expandable polymer grout system further comprises one or more auxiliary components, as described herein.

In certain embodiments, the expandable polymer grout comprises about 40 to about 60 percent by weight the isocyanate component and about 40 to about 60 percent by weight the organic polyol component.

In certain embodiments, the expandable polymer grout system can be deployed (e.g., injected) into or through the wellbore as a pre-mixed system of the isocyanate component and the organic polyol component, wherein at least one of the components is slow-reacting or has delayed activation.

Due to the commonly rapid formation of the polyurethane product upon combining the isocyanate component and organic polyol component, it may be necessary to separate the components until they are placed at or near the target location for the polymer seal. Preferably, the isocyanate component and the organic polyol components each exhibit low viscosities that are less than 500 cP, more preferably less than 200 cP, and even more preferably less than 100 cP. In certain embodiments, the expandable polymer grout system can be deployed (e.g., injected) into or through the wellbore as a two-component system, wherein the isocyanate component and the organic polyol component are introduced separately. In certain embodiments, the isocyanate component and the organic polyol component are mixed downhole, for example near or at the formation face that is the target location.

In example embodiments, the isocyanate component and the organic polyol component will be in liquid form, where the viscosity of the components may vary. In other embodiments, the isocyanate component and the organic polyol component may be dissolved in inert solvents to reduce the viscosities.

In certain embodiments, the expandable polymer grout system yields a flexible/elastomeric material. In certain embodiments, the expandable polymer grout system yields a low-permeability seal along a formation face after polymerization and curing. In certain embodiments, the expandable polymer grout system yields materials or a polymer seal that exhibit chemical bonding to the formation, the casing/pipe, or both.

Isocyanate Component

According to the embodiments, the isocyanate component may comprise one or more types of isocyanate compounds. In certain embodiments, the isocyanate compound is a polyisocyanate having two or more functional groups, e.g., two or more NCO functional groups. According to one embodiment, the polyisocyanate includes those represented by the formula Q(NCO), where n is a number from 2-5 and Q is an aliphatic hydrocarbon group containing 2-18 carbon atoms, a cycloaliphatic hydrocarbon group containing 5-10 carbon atoms, an araliphatic hydrocarbon group containing 8-13 carbon atoms, or an aromatic hydrocarbon group containing 6-15 carbon atoms.

Suitable isocyanates for purposes of the present invention include, but are not limited to, aliphatic and aromatic isocyanates. In certain embodiments, the isocyanate is selected from the group consisting of diphenylmethane diisocyanates (MDIs), polymeric diphenylmethane diisocyanates (pMDIs), toluene diisocyanates (TDIs), hexamethylene diisocyanates (HDIs), isophorone diisocyanates (IPDIs), ethylene diisocyanate; 1,4-tetramethylene diisocyanate; 1,12-dodecane diisocyanate; cyclobutane-1,3-diisocyanate; cyclohexane-1,3- and -1,4-diisocyanate, and mixtures of these isomers; 2,4- and 2,6-hexahydrotoluene diisocyanate and mixtures of these isomers; dicyclohexylmethane-4,4'-diisocyanate 1,3- and 1,4-phenylene diisocyanate; naphthylene-1,5-diisocyanate; triphenylmethane-4,4',4"-triisocyanate; polyphenyl-polymethylene-polyisocyanates of the type which may be obtained by condensing aniline with formaldehyde, followed by phosgenation (polymeric MDI); norbornane diisocyanates; m- and p-isocyanatophenyl sulfonylisocyanates; perchlorinated aryl polyisocyanates; modified polyfunctional isocyanates containing carbodiimide groups, urethane groups, allophonate groups, isocyanurate groups, urea groups, or biruret groups; polyfunctional isocyanates obtained by telomerization reactions; polyfunctional isocyanates containing ester groups; and polyfunctional isocyanates containing polymeric fatty acid groups; and combinations thereof.

Suitable isocyanates for use in the expandable polymer grouts described herein include but are not limited to: toluene diisocyanate; 4,4'-diphenylmethane diisocyanate; m-phenylene diisocyanate; 1,5-naphthalene diisocyanate; 4-chloro-1; 3-phenylene diisocyanate; tetramethylene diisocyanate; hexamethylene diisocyanate; 1,4-dicyclohexyl diisocyanate; 1,4-cyclohexyl diisocyanate, 2,4,6-toluylene triisocyanate, 1,3-diisopropylphenylene-2,4-diisocyanate; 1-methyl-3,5-diethylphenylene-2,4-diisocyanate; 1,3,5-triethylphenylene-2,4-diisocyanate; 1,3,5-triisoproply-phenylene-2,4-diisocyanate; 3,3'-diethyl-bisphenyl-4,4'-diisocyanate; 3,5,3',5'-tetraethyl-diphenylmethane-4,4'-diisocyanate; 3,5,3',5'-tetraisopropyldiphenylmethane-4,4'-diisocyanate; 1-ethyl-4-ethoxy-phenyl-2,5-diisocyanate; 1,3,5-triethyl benzene-2,4,6-triisocyanate; 1-ethyl-3,5-diisopropyl benzene-2,4,6-triisocyanate and 1,3,5-triisopropyl benzene-2,4,6-triisocyanate. Other suitable rigid polyurethane foams can also be prepared from aromatic diisocyanates or isocyanates having one or two aryl, alkyl, arakyl or alkoxy substituents wherein at least one of these substituents has at least two carbon atoms.

In certain embodiments, the isocyanate has an NCO content of from about 25 to about 33 weight percent; a nominal functionality of from about 2 to about 3.5; and a viscosity of from about 60 to about 2000 cps, or about 200 to about 700 cps, at 25° C. (77° F.).

In certain embodiments, the isocyanate components comprise polymeric diphenylmethane diisocyanate.

In certain embodiments, the isocyanate component may be an isocyanate prepolymer. An isocyanate prepolymer comprises a reaction product of an isocyanate and a polyol and/or a polyamine. The isocyanate used in the prepolymer can be any isocyanate as described above. The polyol used to form the prepolymer is typically selected from the group of ethylene glycol, diethylene glycol, propylene glycol, dipropylene glycol, butane diol, glycerol, trimethylolpropane, triethanolamine, pentaerythritol, sorbitol, biopolyols, and combinations thereof. The polyamine used to form the prepolymer is typically selected from the group of ethylene diamine, toluene diamine, diaminodiphenylmethane and polymethylene polyphenylene polyamines, aminoalcohols, and combinations thereof. Suitable non-limiting examples of aminoalcohols include ethanolamine, diethanolamine, triethanolamine, and combinations thereof.

In certain embodiments, the isocyanate compounds may also be provided in a chemically "blocked" state, whereby a reaction to "deblock" the isocyanate may happen prior to polymerization, optionally under downhole conditions, to expose the active isocyanate functionalities. The exposed isocyanates will then react with the organic alcohol groups of the polyol to form the urethane bonds. As such, blocked isocyanate compounds can be used to prevent premature reaction of the isocyanate component with the organic polyol component. Blocked isocyanates regenerate the isocyanate function through heating. Typical unblock temperatures range between 65 to 200° C., depending on the isocyanate structure and blocking agent.

In certain embodiments, the isocyanate component comprises blocked isocyanate compounds, or an isocyanate compound that has been protected with a blocking agent.

Suitable isocyanate blocking agents may include alcohols (including phenols), ethers, phenols, malonate esters, methylenes, aceto acetate esters, lactams, oximes, ureas, bisulphites, mercaptans, triazoles, pyrazoles, secondary amines, glycolic acid esters, acid amides, aromatic amines, imides, diaryl compounds, imidazoles, carbamic acid esters, or sulfites.

Exemplary phenolic blocking agents include phenol, cresol, xylenol, chlorophenol, ethylphenol and the like.

Lactam blocking agents include gamma-pyrrolidone, laurinlactam, epsilon-caprolactam, delta-valerolactam, gamma-butyrolactam, beta-propiolactam and the like.

Methylene blocking agents include acetoacetic ester, ethyl acetoacetate, acetyl acetone and the like.

Oxime blocking agents include formamidoxime, acetaldoxime, acetoxime, methyl ethylketoxine, diacetylmonoxime, cyclohexanoxime and the like.

Mercaptan blocking agent include butyl mercaptan, hexyl mercaptan, t-butyl mercaptan, thiophenol, methylthiophenol, ethylthiophenol and the like.

Acid amide blocking agents include acetic acid amide, benzamide and the like. Imide blocking agents include succinimide, maleimide and the like.

Amine blocking agents include xylidine, aniline, butylamine, dibutylamine diisopropyl amine and benzyl-tert-butyl amine and the like.

Imidazole blocking agents include imidazole, 2-ethylimidazole and the like.

Imine blocking agents include ethyleneimine, propyleneiniine and the like.

Triazole blocking agents include 1,2,4-triazole, 1,2,3-benzotriazole, 1,2,3-tolyl triazole and 4,5-diphenyl-1,2,3-triazole.

Alcohol blocking agents include methanol, ethanol, propanol, butanol, amyl alcohol, ethylene glycol monomethyl ether, ethylene glycol monoethyl ether, ethylene glycol monobutyl ether, diethylene glycol monomethyl ether, propylene glycol monomethyl ether, benzyl alcohol, methyl glycolate, butyl glycolate, diacetone alcohol, methyl lactate, ethyl lactate and the like. Additionally, any suitable aliphatic, cycloaliphatic or aromatic alkyl monoalcohol may be used as a blocking agent in accordance with the present disclosure. For example, aliphatic alcohols, such as methyl, ethyl, chloroethyl, propyl, butyl, amyl, hexyl, heptyl, octyl, nonyl, 3,3,5-trimethylhexyl, decyl, and lauryl alcohols, and the like may be used. Suitable cycloaliphatic alcohols include, for example, cyclopentanol, cyclohexanol and the like, while aromatic-alkyl alcohols include phenyl carbinol, methylphenylcarbinol, and the like.

Dicarbonylmethane blocking agents include malonic acid esters such as diethyl malonate, dimethyl malonate, di(iso)propyl malonate, di(iso)butyl malonate, di(iso)pentyl malonate, di(iso)hexyl malonate, di(iso)heptyl malonate, di(iso)octyl malonate, di(iso)nonyl malonate, di(iso)decyl malonate, alkoxyalkyl malonates, benzylmethyl malonate, di-tert-butyl malonate, ethyl-tert-butyl malonate, dibenzyl malonate; and acetylacetates such as methyl acetoacetate, ethyl acetoacetate, propyl acetoacetate, butyl acetoacetate and alkoxyalkyl acetoacetates; cyanacetates such as cyanacetic acid ethylester; acetylacetone; 2,2-dimethyl-1,3-dioxane-4,6-dione; methyl trimethylsilyl malonate, ethyl trimethylsilyl malonate, and bis(trimethylsilyl) malonate. Malonic or alkylmalonic acid esters derived from linear aliphatic, cycloaliphatic, and/or arylalkyl aliphatic alcohols may also be used. Such esters may be made by alcoholysis using any of the above-mentioned alcohols or any monoalcohol with any of the commercially available esters (e.g., diethylmalonate). For example, diethyl malonate may be reacted with 2-ethylhexanol to obtain the bis-(2-ethylhexyl)-malonate. It is also possible to use mixtures of alcohols to obtain the corresponding mixed malonic or alkylmalonic acid esters. Suitable alkylmalonic acid esters include: butyl malonic acid diethylester, diethyl ethyl malonate, diethyl butyl malonate, diethyl isopropyl malonate, diethyl phenyl malonate, diethyl n-propyl malonate, diethyl isopropyl malonate, dimethyl allyl malonate, diethyl chloromalonate, and dimethyl chloro-malonate.

Other isocyanate blocking agents are described in, for example, U.S. Pat. Nos. 6,288,176, 5,559,064, 4,637,956, 4,870,141, 4,767,829, 5,108,458, 4,976,833, and 7,157,527, U.S. Patent Application Publication Nos. 20050187314, 20070023288, 20070009750, 20060281854, 20060148391, 20060122357, 20040236021, 20020028932, 20030194635, and 20030004282, each of which is incorporated herein by reference. Mixtures of the above-listed isocyanate blocking agents may also be used.

Blocked polyisocyanate compounds may include, for example, polyisocyanates having at least two tree isocyanate groups per molecule, where the isocyanate groups are blocked with an above-described isocyanate blocking agent.

Blocked isocyanates may be prepared by reaction of one of the above-mentioned isocyanate compounds and a blocking agent by a conventionally known appropriate method.

In other embodiments, the blocked isocyanates used in embodiments disclosed herein may be any isocyanate where the isocyanate groups have been reacted with an isocyanate blocking agent so that the resultant capped isocyanate is stable to active hydrogens at room temperature but reactive with active hydrogens at elevated temperatures, such as between about 65° C. to 200° C.

Blocked polyisocyanate compounds are typically stable at room temperature. When heated to a temperature about the minimum unblocking temperature, the blocking agent is dissociated to regenerate the free isocyanate groups, which may readily react with hydroxyl groups of the organic polyol compounds.

As an alternative to an external or conventional blocking agent, the isocyanates of the present disclosure may be internally blocked. The term internally blocked, as used herein, indicates that there are uretdione groups present which unblock at certain temperatures to free the isocyanate groups for cross-linking purposes. Isocyanate dimers (also referred to as uretdiones) may be obtained by dimerizing diisocyanates in the presence of phosphine catalysts. In certain embodiments, the blocking agent is selected from the group consisting of: methylethylcetoxime (MEKO), diethyl malonate (DEM), 3,5-dimethylpyrazole (DMP).

Organic Polyol Component

According to the embodiments, the organic polyol component may comprise one or more types of organic polyol compounds, which are reactive with the isocyanate compounds. Organic polyol compounds suitable for use in the present invention may include, but are not limited to, polyether polyols, polyester polyols, polycarbonate polyols, and biorenewable polyols. Such polyols may be used alone or in suitable combination as a mixture.

General functionality of polyols used in the present invention is between about 2 to about 5, or about 2 to about 3. The weight average molecular weight of polyols may be between about 500 and about 10,000, or about 500 and about 5,000 g/mol.

The proportion of the organic polyol compounds is generally of between about 10 and about 80% by weight, preferably between about 20 and about 50% based of the expandable polymer grout system.

Polyether polyols for use in the present invention include alkylene oxide polyether polyols such as ethylene oxide polyether polyols and propylene oxide polyether polyols and copolymers of ethylene and propylene oxide with terminal hydroxyl groups derived from polyhydric compounds, including diols and triols; for example, ethylene glycol, propylene glycol, 1,3-butane diol, 1,4-butane diol, 1,6-hexane diol, neopentyl glycol, diethylene glycol, dipropylene glycol, pentaerythritol, glycerol, diglycerol, trimethylol propane, and similar low molecular weight polyols.

Polyester polyols for use in the present invention include, but are not limited to, those produced by reacting a dicarboxylic acid with an excess of a diol, for example, adipic acid with ethylene glycol or butanediol, or reaction of a lactone with an excess of a diol such as caprolactone with propylene glycol. In addition, polyester polyols for use in the present invention may also include: linear or lightly branched aliphatic (e.g. adipates) polyols with terminal hydroxyl group; low molecular weight aromatic polyesters; polycaprolactones; polycarbonate polyol. Those linear or lightly branched aliphatic (e.g. adipates) polyols with terminal hydroxyl group are produced by reacting a dicarboxyl acids with an excess of diols, triols and their mixture; those dicarboxyl acids include, but are not limited to, for example, adipic acid, AGS mixed acid; those diols, triols include, but are not limited to, for example, ethylene glycol, diethylene glycol, propylene glycol, dipropylene glycol, 1,4-butane diol, 1,6-hexane diol, glycerol, trimethylolpropane and pentaerythritol.

In certain embodiments, the organic polyol component is selected from aromatic polyester polyol and an aliphatic polyester polyol.

The aromatic polyester polyol is typically formed via the condensation of a glycol and a dicarboxylic acid or acid derivative. The functionality, structure, and molecular weight of the polyester polyol can be varied to tailor the processing characteristics and physical properties of the expanded polymer grout system to a particular application. In certain embodiments, the aromatic polyester polyol has a functionality of greater than 2 or about 2 to about 5 and a weight-average molecular weight of from 500 to 5,000 g/mol, or about 1,000 to 3,000 g/mol. In certain embodiments, the aromatic polyester polyol has a hydroxyl value of from 100 to 500 mg KOH/g. In certain embodiments, the aromatic polyester polyol has a viscosity at 25° C. of from about 5,000 to about 20,000 cps, or about 9,000 to about 14,000 cps. In certain embodiments, the aromatic polyester polyol has a specific gravity of about 1.0 to about 1.2 g/cm$^3$. In certain embodiments, the aromatic polyester polyol is present in the organic polyol component in an amount of from about 25 to about 100 parts by weight, based on 100 parts by weight of the total weight of the polyols present in the organic polyol component.

The aliphatic polyester polyol is typically formed via the condensation of a glycol and a dicarboxylic acid or acid derivative. In certain embodiments, the aliphatic polyester polyol has a functionality of greater than 2 or about 2 to about 5 and a weight-average molecular weight of from 500 to 5,000 g/mol, or about 1,000 to 3,000 g/mol. In certain embodiments, the aliphatic polyester polyol has a hydroxyl value of from 20 to 400 mg KOH/g. In certain embodiments, the aliphatic polyester polyol has a viscosity at 25° C. of from about 10,000 to about 20,000 cps, or about 15,000 to about 19,000 cps. In certain embodiments, the aliphatic polyester polyol has a specific gravity of about 1.0 to about 1.2 g/cm$^3$. In certain embodiments, the aliphatic polyester polyol is present in the organic polyol component in an amount of from about 2 to about 100 parts by weight, based on 100 parts by weight of the total weight of the polyols present in the organic polyol component.

In certain embodiments, one or more aliphatic polyester polyol and one or more aromatic polyester polyol are both present in the organic polyol component, for example in a ratio of from 1:5 to 1:15.

Polycarbonate polyols are derived from carbonic acid that can be produced through the polycondensation of diols with phosgene, although transesterification of diols, commonly hexane diol, with a carbonic acid ester, such as diphenylcarbonate.

Biorenewable polyols suitable for use in the present invention include castor oil, sunflower oil, palm kernel oil, palm oil, canola oil, rapeseed oil, soybean oil, corn oil, peanut oil, olive oil, algae oil, and mixtures thereof.

Blowing Agents, Catalysts and Other Auxiliary Components

Typically, the isocyanate component and the organic polyol component are reacted in the presence of a blowing agent to form the expandable polymer grout. The blowing agent may be a physical blowing agent, a chemical blowing agent, or a combination of a physical blowing agent and a chemical blowing agent.

The term "physical blowing agent" refers to blowing agents that do not chemically react with the isocyanate and/or the organic polyol component. The physical blowing agent can be a gas or liquid. The liquid physical blowing agent typically evaporates into a gas when heated, and typically returns to a liquid when cooled. Examples of physical blowing agents include volatile liquids such as chlorofluorocarbons, partially halogenated hydrocarbons or non-halogenated hydrocarbons like propane, n-butane, isobutane, n-pentane, isopentane cyclopentane and/or neopentane. In a particular embodiment, the blowing agent comprises, or consists essentially of, cyclopentane.

The term "chemical blowing agent" describes blowing agents which chemically react with the isocyanate or with other components to release a gas for foaming. Examples of chemical blowing agents include water, gaseous compounds such as nitrogen or carbon dioxide, gas (e.g. CO2) forming compounds such as azodicarbonamides, carbonates, bicarbonates, citrates, nitrates, borohydrides, carbides such as alkaline earth and alkali metal carbonates and bicarbonates e.g. sodium bicarbonate and sodium carbonate, ammonium carbonate, diaminodiphenylsulphone, hydrazides, malonic acid, citric acid, sodium monocitrate, ureas, azodicarbonic methyl ester, diazabicyclooctane and acid/carbonate mixtures. In a particular embodiment, the blowing agent comprises, or consists essentially of, water.

In certain embodiments, the total amount of the blowing agents present in the reaction mixture or in the organic polyol component in an amount of from about 1 to about 30, or about 10 to about 25, parts by weight, based on 100 parts by weight of the organic polyols present in the organic polyol component.

In one embodiment, the expandable polymer grout system comprises a physical blowing agent. In one embodiment, the expandable polymer grout system comprises a chemical blowing agent. In one embodiment, the expandable polymer grout system comprises both a physical blowing agent and a chemical blowing agent.

In one embodiment, the expandable polymer grout system comprises one or more catalysts. In certain embodiments, the one or more catalysts are present in the organic polyol component to catalyze the reaction between the isocyanate and the polyols. The catalyst may include any suitable catalyst or mixtures of catalysts known in the art. Examples of suitable catalysts include, but are not limited to, gelation catalysts, e.g., amine catalysts in dipropylene glycol; blowing catalysts, e.g., bis(dimethylaminoethyl)ether in dipropylene glycol; and metal catalysts, e.g., tin, bismuth, lead, etc. One non-limiting example of a suitable catalyst is N,N-dimethylcyclohexylamine.

In one embodiment, the expandable polymer grout system comprises one or more surfactants. The surfactant typically supports homogenization of the blowing agent and the polyol and regulates a cell structure of the expandable polymer grout. In certain embodiments, the one or more surfactants are present in the organic polyol component. The surfactant may include any suitable surfactant or mixtures of surfactants known in the art. Non-limiting examples of suitable surfactants include various silicone surfactants, salts of sulfonic acids, e.g. alkali metal and/or ammonium salts of oleic acid, stearic acid, dodecylbenzene- or dinaphthylmethane-disulfonic acid, and ricinoleic acid, foam stabilizers such as siloxaneoxyalkylene copolymers and other organopolysiloxanes, oxyethylated alkyl-phenols, oxyethylated fatty alcohols, paraffin oils, castor oil, castor oil esters, and ricinoleic acid esters, and cell regulators, such as paraffins, fatty alcohols, and dimethylpolysiloxanes. One specific, non-limiting example of a surfactant is a silicone-polyether block copolymer.

The expandable polymer grout system, or organic polyol component, may optionally include one or more additional auxiliary components. Suitable additives for purposes of the instant disclosure include, but are not limited to, chain-extenders, crosslinkers, chain-terminators, processing additives, adhesion promoters, anti-oxidants, defoamers, anti-foaming agents, water scavengers, molecular sieves, fumed silicas, ultraviolet light stabilizers, fillers, thixotropic agents, silicones, colorants, inert diluents, plasticizers, silane coupling agent, cell stabilizers, fillers, or any combination thereof.

In one embodiment, the proportion of the auxiliary components present in the expandable grout composition is between about 5 and about 80 percent by weight, or about 10 and about 60 percent by weight, of the total weight of the expandable polymer grout system.

In certain embodiments, the two component systems have the isocyanate delivered as an isolated component (not combined with other reactants or additives) and the organic polyol component may be pre-blended with blowing agents, catalysts and other auxiliary components, as described above.

In certain embodiments, the performance properties of the expandable polymer grout system may be adjusted through the addition of the blowing agents, catalysts and auxiliary components.

In certain embodiments, it may be desirable to combine or mix the expandable polymer grout system with other functional materials, such as fluid-loss control particulates to mitigate premature or excessive loss of the liquid polymer into the formation or annulus prior to the polymer setting up or crosslinking in the desired locations. In certain embodiments, the expandable polymer grout system may be combined with cement such as to enhance certain properties of the cement. Combinations with materials such as cement may provide enhanced material properties for operations such as forming an improved seal for plug and abandonment, or to squeeze a casing leak in a collar, or to squeeze off perforations. Prior to the polymer crosslinking or otherwise reacting, the disclosed polymers may exhibit flow properties that are more Newtonian and less viscous than liquid cement, thereby flowing into tighter flowpaths than cement alone otherwise might.

Methods of Use

The expandable polymer grout system according to the embodiments described herein may be deployed or injected downhole to form a polymer seal along a subterranean formation, including but not limited to a hydrocarbon well (or wellbore) or an annulus between a casing and a formation face. Methods of deployment downhole will depend on both the characteristics and reactivity of the expandable polymer grout system as well as the intended usage downhole.

In certain embodiments, a method for creating a polymer seal along a formation face within a wellbore from an expandable polymer grout system, comprises:

(I) providing an expandable polymer grout system to a target location within or through a wellbore, wherein the expandable polymer grout system comprises: (i) an isocyanate component comprising one or more isocyanate compounds; and (ii) an organic polyol component comprising one or more organic polyol compounds; in the presence of (iii) one or more blowing agents;

(II) combining components (i), (ii) and (iii) of the expandable polymer grout system to facilitate the polymerization reaction to form the expandable polymer grout at the target location; and (III) allowing the expandable polymer grout to cure at the target location thereby sealing a formation face. In certain embodiments, one or more polymer seals formed from the system according to the embodiments may be formed at targeted sites or zones, rather than filling an entire feature or cavity. For example, a polymer seal formed from the systems according to the embodiments may be set at a target location or target zone of a specific depth in a well, rather than filling the well. To provide sealing at a specific depth, spotting of the polyurethane precursors may be isolated using packers, optionally using coiled tubing, coiled hose(s), custom umbilical, or other conduit to target the solution placement.

In certain embodiments, the isocyanate component and organic polyol component are injected through a form of dual-string injection, where each component is injected through an isolated tube, are combined optionally in a mixing chamber placed at the target interval (optionally between packers), and the combined precursors are then injected from the mixing chamber into the wellbore and/or annular space. This injection will be followed by a static curing time, to allow the expandable polymer to first expand and then to cure into the fully polymerized (optionally hardened) state. The curing may optionally be carried out under additional pressure applied through both the work-string and/or the annulus (possibly to control the degree of expansion and/or density or to further squeeze the precursor blend into the annulus). Injection of the precursors through the mixing chamber may optionally be followed by a flush stage of an inert fluid or gas (that does not participate in the polymerization/curing process) prior to expansion and curing to purge and clean the mixing chamber.

In certain embodiments, the isocyanate and polyol components of the expandable polymeric grout are injected into the hydrocarbon well or wellbore separately.

In certain embodiments, the components of the expandable polymer grout are injected into the hydrocarbon well through dual-string injection or through isolated tubes.

In certain embodiments, the components of the expandable polymer grout are combined in a mixing chamber prior to injection into the region in which a polymer seal is to be formed.

The expandable polymer grout system can be used in methods of creating polymer seals within or through a wellbore. In certain embodiments, the method for creating polymer seals within a wellbore comprises: (I) providing an expandable polymer grout system to a target location, wherein the expandable polymer grout system comprises: (i) an isocyanate component comprising one or more isocyanate compounds; and (ii) an organic polyol component comprising one or more organic polyol compounds; in the presence of (iii) one or more blowing agents; (II) combining components (i), (ii) and (iii) of the expandable polymer grout system to facilitate the polymerization reaction to form the expandable polymer grout at the target location and (III) allowing the expandable polymer grout to cure at the target location to form the polymer seal.

In certain embodiments, the initial combining of the components may be conducted at the surface of the well, prior to being pumped into the wellbore, while in other embodiments the components will be combined inside the wellbore. In certain embodiments, the target location is at an open hole location within the wellbore where no casing is present. In certain embodiments, the target location is at a location accessed through the wellbore. The polymer seal forms a barrier along the formation face of the wellbore that prevents or inhibits fluid flow between the wellbore and the formation.

In certain embodiments, the method comprises creating a polymer seal along a formation face in the wellbore during at least one of a drilling operation, a casing operation, a liner operation, a completion operation, a recompletion operation, a primary cementing operation, and a staged cementing operation.

Examples of Deploying Expandable Polymer Grout in Well Systems

FIGS. 1A through 5 illustrate examples of well systems in which the previously described expandable polymer grout systems can be applied to seal a formation face. The examples of FIGS. 1A through 5 illustrate the complex geometries in which the polymer grout can provide advantages over prior approaches to sealing a wellbore. The well systems of FIGS. 1A through 5 are illustrative examples and the polymer grout described herein can be applied to formation faces in well systems with other configurations as well.

Referring to FIG. 1A, well system 100 in formation 102 is illustrated. The well system 100 includes a primary wellbore 104 having a generally vertical orientation. The primary wellbore 104 is lined with a primary casing 106 along portions of the wellbore. A secondary wellbore 124 branches from primary wellbore 104 such that the longitudinal axes of the two wellbores form an acute angle. A portion of secondary wellbore 124 is lined with a secondary casing 126.

The terms "primary" and "secondary" are used in the embodiments described herein to differentiate one wellbore and its associated features from another wellbore and its associated features. In some examples, the primary wellbore may be a parent wellbore and the secondary wellbore may be a lateral wellbore. In other examples, the secondary wellbore may be a parent wellbore and the primary wellbore may be a lateral wellbore. Accordingly, the terms "primary" and "secondary" should not be interpreted as imposing other limitations on the wellbores and features described herein.

The primary wellbore 104 and secondary wellbore 124 intersect at a junction 114 at which an interval of the formation face is exposed to the wellbore as indicated by the open hole formation 103. Given the tubular shape of casing strings and the geometry of the junction 114, it is challenging to place casing to completely seal all of the formation face at the junction 114. Put another way, the junction 114 may experience a discontinuity in the casings where the formation face is exposed to the wellbores.

Accordingly, a deployment system 110 can be inserted into the well system 100 to place expandable polymer grout system 112 at the location of the junction 114 in order to form a polymer seal along the open hole formation 103. Specifically, with the primary casing 106 and secondary casing 126 in place, portions of the junction remain unsealed with casing due to the geometry of the junction such that formation face is exposed at the open hole formation 103.

A method for sealing the open hole formation 103 with a polymer seal can begin with placing a primary barrier 108 in the primary wellbore 104 and placing a secondary barrier 128 in the secondary wellbore 124. The primary and secondary barriers can be any of a variety of barriers used in well completion including a bridge plug, packer, cement retainer, or other physical barrier. The purpose of the primary and secondary barriers is to prevent the expandable polymer grout system from flowing away from the target depth or junction before curing sets the polymer seal at the junction. Accordingly, the primary barrier 108 can be placed in the primary wellbore 104 at a location near or immediately below the junction 114. Similarly, the secondary barrier 128 can be placed in the secondary wellbore 124 at the top of the secondary casing 126 and near or immediately below the junction 114.

Once the primary barrier 108 and the secondary barrier 128 are in place in the well system, the deployment system 110 can be inserted into the well system. Specifically, in the example of FIG. 1A, the deployment system 110 is inserted into the primary wellbore 104 to the location of the junction 114. As illustrated in FIG. 1A, a proximal barrier 109 can surround the deployment system 110 to prevent the expandable polymer grout system from flowing upward in the primary wellbore 104 away from the junction 114. The proximal barrier 109 can be any of a variety of barriers, including a bridge plug, a packer, a retainer, or other physical barrier. The deployment system 110 can have a variety of configurations, examples of which are described further below in connection with FIGS. 6A through 8. Generally, the deployment system 110 can include a deployment tubular 107 and a deployment tool 111. The deployment tubular 107 is used to insert the deployment system 110 into the wellbore. In certain embodiments, the deployment tubular 107 can serve as the conduit through which the expandable polymer grout system 112 passes to reach the junction 114. The deployment tool 111 directs the expandable polymer grout system 112 from the deployment system 110 and into the junction so that it will contact the open hole formation 103. In certain embodiments, the deployment tool 111 can include a tail pipe for controlling the direction of flow of the expandable polymer grout system. As another example, the deployment tool 111 can include a mixer for mixing the components of the expandable polymer grout system 112. As another example, the deployment tool 111 can include cannisters that contain and mixes the precursor components of the expandable polymer grout system. As yet another example, the deployment tool 111 can include a fluid to apply pressure to deploy the expandable polymer grout system 112 at the junction 114.

Once the expandable polymer grout system 112 is delivered to the junction 114, the deployment system 110 can be retracted in the primary wellbore 104 so that it does not interfere with the curing of the expandable polymer grout system 112. As the expandable polymer grout system 112 cures, it hardens into a polymer seal 113 that seals the formation face at the open hole formation 103.

Figure 3:
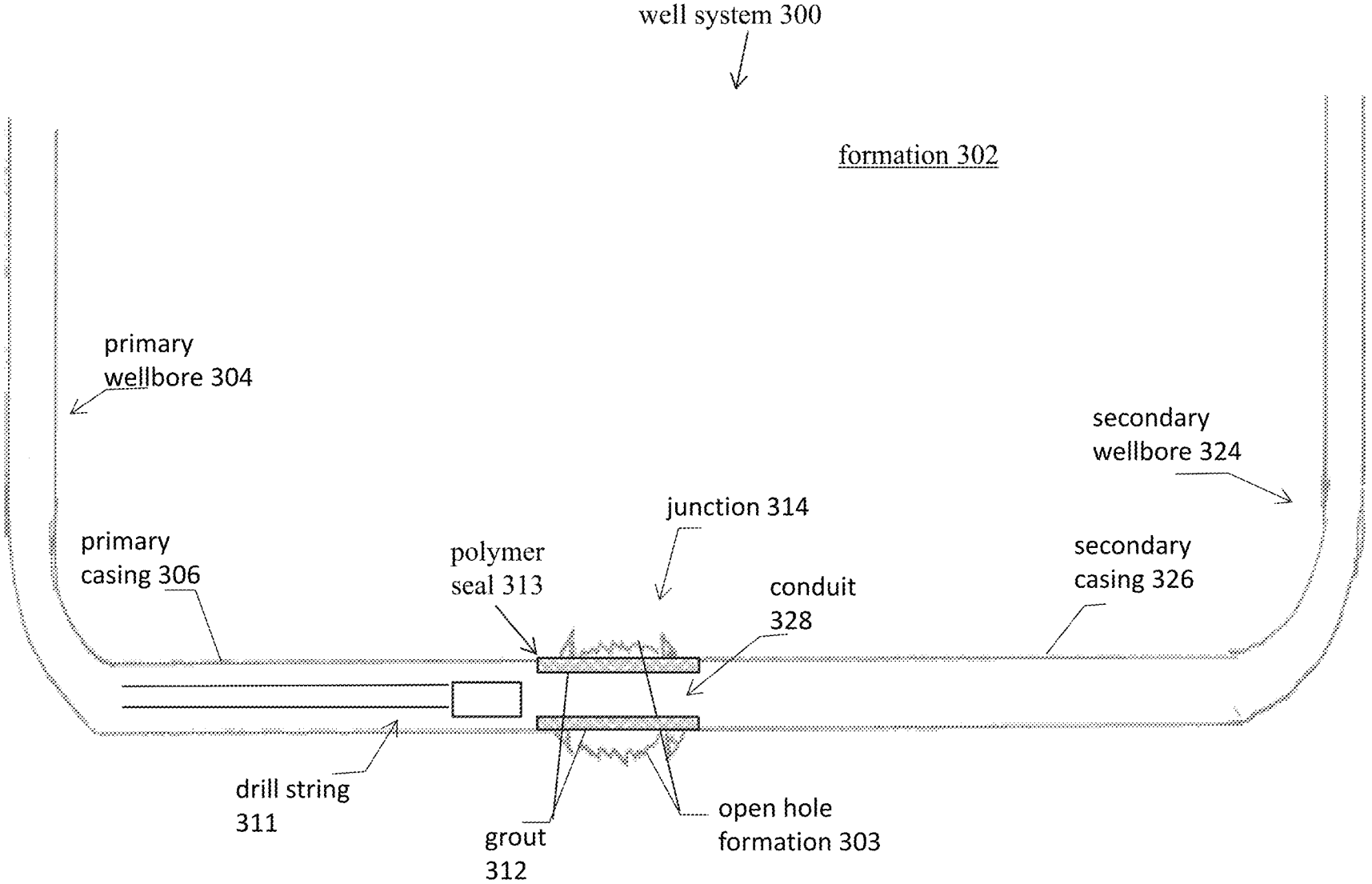
FIG. 3 is a sectional view drawing of another well system in which a polymer seal is placed at a junction of two wells in accordance with the example embodiments described herein.

In certain example well systems, such as that illustrated in FIG. 1A, a conduit through the polymer seal is needed in order to access the lower portions of the primary wellbore 104 and the secondary wellbore 124. The conduit can be achieved using a variety of methods. In one example, as illustrated in the embodiment of FIG. 3, a drill string can be used to drill a conduit through the center of the polymer seal while leaving the perimeter of the polymer seal in place to seal the formation face. In another example, as illustrated in FIG. 6B, the deployment system can include a bladder or other expandable/retractable device the directs the expandable polymer grout system 112 to the perimeter of the wellbore to seal the formation face while maintaining an open conduit through the center of the expandable polymer grout system while it cures into a hardened polymer seal. Thereafter the bladder or the expandable/retractable device can be removed leaving the open conduit through the center of the polymer seal and providing access to the bottom of the wellbore. Although not visible in FIG. 1A, a conduit would be formed through the polymer seal 113 in both the primary wellbore 104 and the secondary wellbore 124 so that access to the bottom of both wellbores is provided.

Figure 1B:
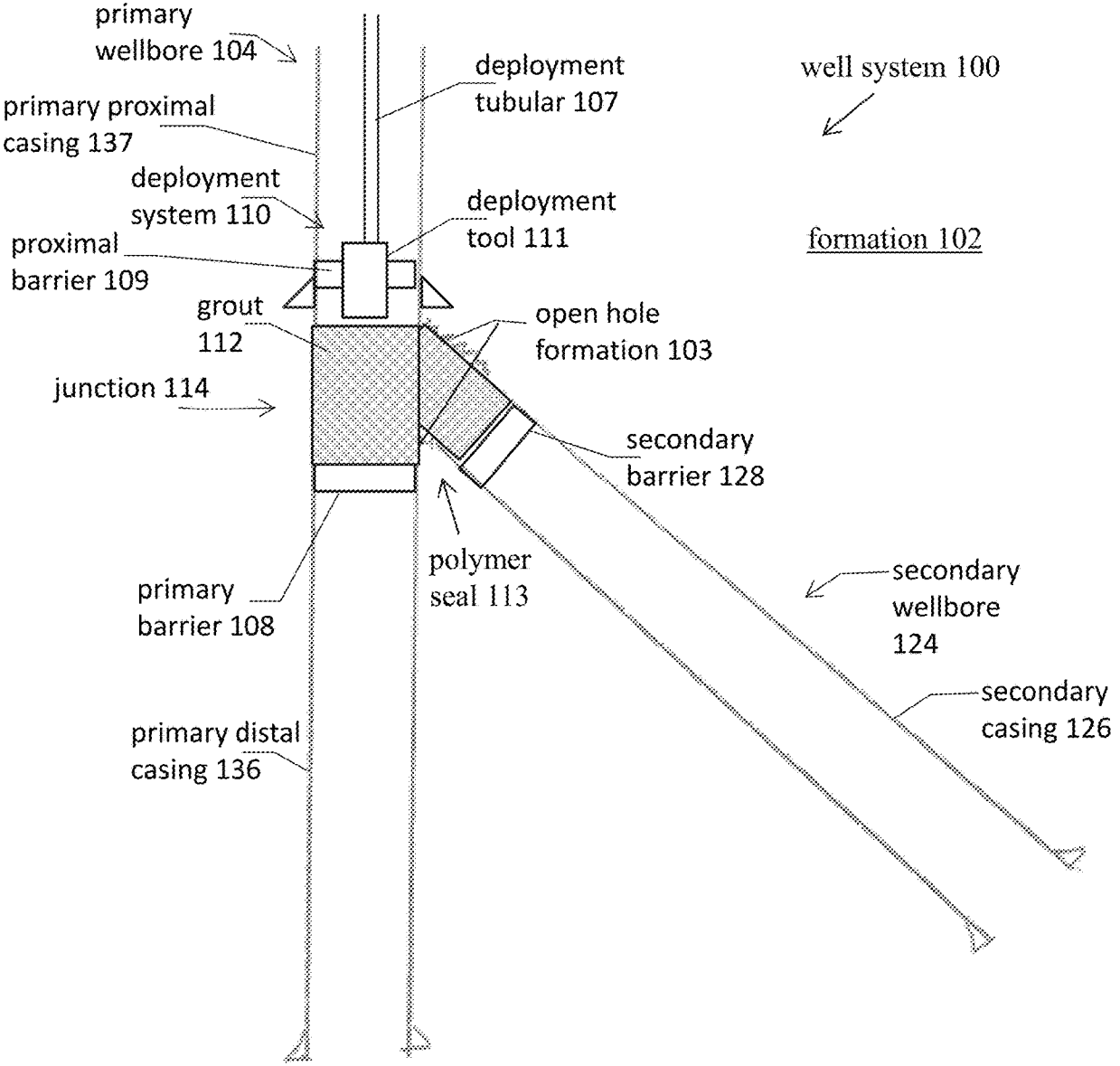
FIG. 1B is a sectional view drawing of a well system similar to the well system of FIG. 1A, but with an open hole section in the primary wellbore adjacent to the junction.

FIG. 1B illustrates the same well system 100 of FIG. 1A, but with a variation. Specifically, FIG. 1A shows the primary casing 106 extending from the area below the junction 114, up through the junction 114, and above the junction 114. As such, in FIG. 1A, the secondary wellbore 124 is drilled through the primary casing 106. In contrast, in FIG. 1B, a primary distal casing 136 is positioned below the junction 114 and a primary proximal casing 137 is positioned above the junction 114. The region of the primary wellbore 104 is an open hole interval where no casing is present. Accordingly, the secondary wellbore 124 is drilled through the exposed open hole formation of the primary wellbore 104 at the junction 114. After the secondary casing 126 is placed in the secondary wellbore 124, the expandable polymer grout system 112 is placed at the junction in the manner described in association with FIG. 1A. The description of the other elements of FIG. 1A is applicable to the same elements illustrated in FIG. 1B.

Figure 2A:
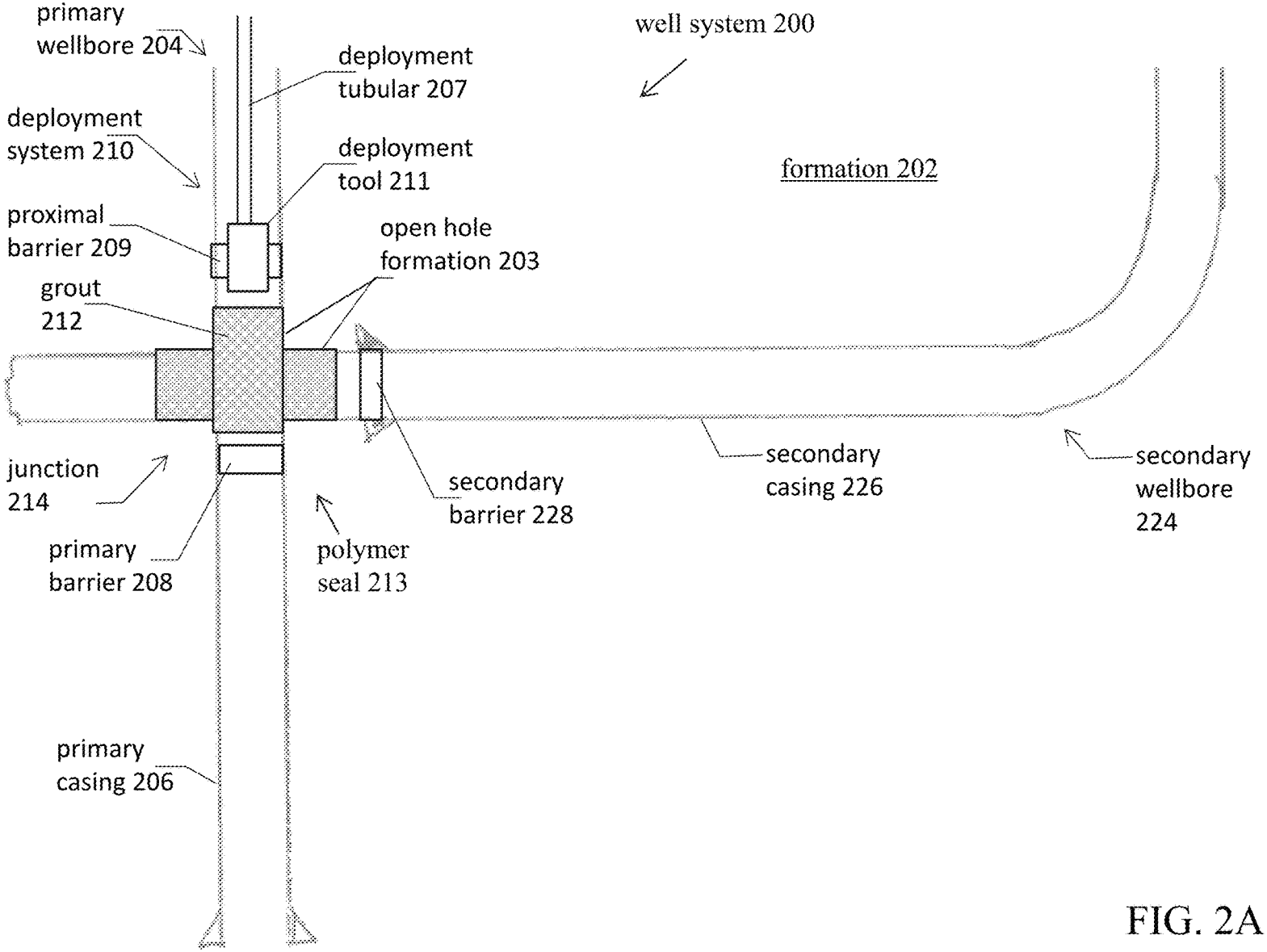
FIG. 2A is a sectional view drawing of another well system in which a polymer seal is placed at a junction of two wells in accordance with the example embodiments described herein.

Referring to FIG. 2A, another example well system 200 located in a formation 202 is illustrated. The well system 200 includes a primary wellbore 204 having a generally vertical orientation. The primary wellbore 204 is lined with a primary casing 206 along portions of the wellbore. A secondary wellbore 224 includes a high-angle portion that intersects the primary wellbore 204 such that the longitudinal axes of the two wellbores form a 90 degree angle at the intersection. A portion of secondary wellbore 224 is lined with a secondary casing 226.

The primary wellbore 204 and secondary wellbore 224 intersect at a junction 214 at which an interval of the formation face is exposed to each wellbore as indicated by the open hole formation 203. Given the tubular shape of casing strings and the geometry of the junction 214, it is challenging to place casing to completely seal off all of the formation face at the junction 214. In other words, the junction 214 is a discontinuity in the casings where the formation face is exposed to the wellbores.

Accordingly, a deployment system 210 can be inserted into the well system 200 to place expandable polymer grout system 212 at the location of the junction 214 in order to form a polymer seal along the open hole formation 203. Specifically, with the primary casing 206 and secondary casing 226 in place, portions of the junction 214 remain unsealed with casing due to the geometry of the junction such that formation face is exposed at the open hole formation 203.

A method for sealing the open hole formation 203 with a polymer seal can begin with placing a primary barrier 208 in the primary wellbore 204 and placing a secondary barrier 228 in the secondary wellbore 224. The primary and secondary barriers can be any of a variety of barriers used in well completion including a bridge plug or a packer. The purpose of the primary and secondary barriers is to prevent the expandable polymer grout system from flowing down into the wellbores before curing sets the polymer seal at the junction. Accordingly, the primary barrier 208 can be placed in the primary wellbore 204 at a depth within the primary casing 206 that is near or immediately below the junction 214. Similarly, the secondary barrier 228 can be placed in the secondary wellbore 224 at a location within the secondary casing 226 that is near or adjacent to the junction 214.

Once the primary barrier 208 and the secondary barrier 228 are in place in the well system, the deployment system 210 can be inserted into the well system. Specifically, in the example of FIG. 2A, the deployment system 210 is inserted into the primary wellbore 204 to the location of the junction 214. As illustrated in FIG. 2A, a proximal barrier 209 can surround the deployment system 210 to prevent the expandable polymer grout system from flowing upward in the primary wellbore 204 away from the junction 214. The proximal barrier 209 can be any of a variety of barriers, including a bridge plug, a packer, a retainer, or other physical barrier. The deployment system 210 can have a variety of configurations, examples of which are described further below in connection with FIGS. 6A through 8. Generally, the deployment system 210 can include a deployment tubular 207 and a deployment tool 211. The deployment tubular 207 is used to insert the deployment system 210 into the wellbore and, in certain embodiments, the deployment tubular 207 can serve as the conduit through which the expandable polymer grout system 212 passes to reach the junction 214. The deployment tool 211 directs the expandable polymer grout system 212 from the deployment system 210 and into the junction so that it will contact the open hole formation 203. As explained previously and in the further examples below, the deployment tool 211 can include one or more of a tail pipe, a mixer, a cannister, a bladder, or an expandable/retractable device.

Once the expandable polymer grout system 212 is delivered to the junction 214, the deployment system 210 can be retracted in the primary wellbore 204 so that it does not interfere with the curing of the expandable polymer grout system 212. As the expandable polymer grout system 212 cures, it hardens into a polymer seal 213 that seals the formation face at the open hole formation 203.

As described previously in connection with FIG. 1A, a conduit can be formed through a center of the polymer seal 213 to provide access to portions of each wellbore beyond the junction 214. Specifically, a primary conduit can be formed coaxially with the primary wellbore 204 and a secondary conduit can be formed coaxially with the secondary wellbore 224. As described in connection with FIG. 1A and the other embodiments herein, the conduit can be formed using a variety of approaches. As one example, a drill string can drill the primary and secondary conduits. As another example, a bladder or other type of expandable/retractable device can form the conduits through the expandable polymer grout system 212 as it cures to form the polymer seal 213.

Figure 2B:
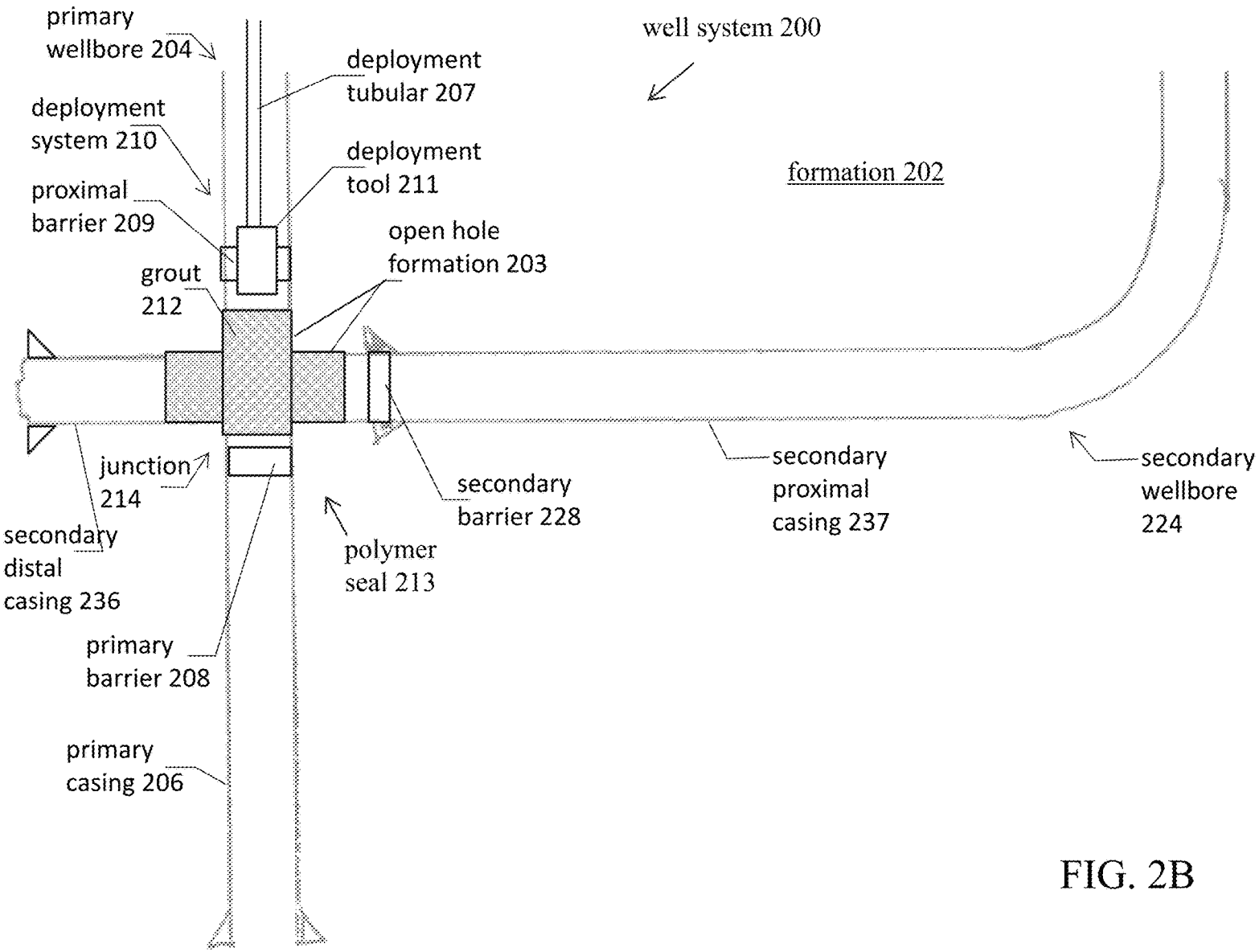
FIG. 2B is a sectional view drawing of a well system similar to the well system of FIG. 2A, but with a distal secondary casing in the secondary wellbore adjacent to the junction.

FIG. 2B illustrates the same well system 200 of FIG. 2A, but with a variation. Specifically, FIG. 2A shows the secondary casing 226 extending from the area adjacent to the junction 214 up toward the surface. In contrast, in FIG. 2B illustrates that a secondary distal casing 236 can be placed at a distal interval of the well beyond the junction 214 and a secondary proximal casing 237 can be placed at a proximal interval of the well on a side opposite the junction 214 from the secondary distal casing 236. Accordingly, in the well system of FIG. 2B, the interval of the secondary wellbore at the junction 214 is open hole and casing is positioned within the secondary wellbore 224 on either side of the junction 214. After the secondary distal casing 236 and secondary proximal casing 237 are in place, the expandable polymer grout system 212 is placed at the junction in the manner described in association with FIG. 2A. The description of the other elements of FIG. 2A is applicable to the same elements illustrated in FIG. 2B.

Referring now to FIG. 3, another example well system 300 located in a formation 302 is illustrated. The configuration of well system 300 may be encountered in a geothermal well or a hydrocarbon well, as examples. The well system 300 includes a primary wellbore 304 having a generally vertical section and a high-angle section. The primary wellbore 304 is lined with a primary casing 306 along portions of the wellbore. Similarly, a secondary wellbore 324 includes a generally vertical section and a high-angle section and a portion of the secondary wellbore is lined with a secondary casing 226. The longitudinal axes of the high-angle sections of the primary wellbore 304 and the secondary wellbore 324 are aligned so that they intersect at junction 314 where both wellbores have similar well angles at the point of intersection.

At the junction 314 an interval of the formation face is exposed as indicated by the open hole formation 303. Given the tubular shape of casing strings and the geometry of the junction 314 along the high-angle sections of the wellbores 304 and 324, it is challenging to place casing to completely seal off all of the formation face at the junction 314. In other words, the junction 314 is an area of discontinuity in the casing string.

Accordingly, a deployment system similar to the deployment systems previously described can be inserted into the well system 300 to place an expandable polymer grout system 312 at the location of the junction 314 in order to form a polymer seal along the open hole formation 303. FIG. 3 differs from the examples of FIGS. 1 and 2 in that it illustrates the well system after the deployment system has placed the expandable polymer grout system 312 at the junction 314 and the deployment system has been retracted from the well system 300. Nonetheless, the method of placing the expandable polymer grout system 312 at the junction 314 can be similar to the methods described in FIGS. 1 and 2.

After the deployment system has been retracted from the will system, a drill string 311 can be inserted into the primary wellbore 304 as illustrated in FIG. 3. The drill string 311 can be used to drill out the center of the polymer seal 313 to form the conduit 328. While the drill string 311 drills out the center of the polymer seal 313, it leaves the perimeter of the polymer seal 313 intact so that it remains as a seal along the open hole formation 303 and provides the desired seal where casing is absent. Once the conduit 328 is drilled through the polymer seal 313, the primary and second wellbores are in communication such that fluids or equipment can pass between the wellbores.

Figure 4:
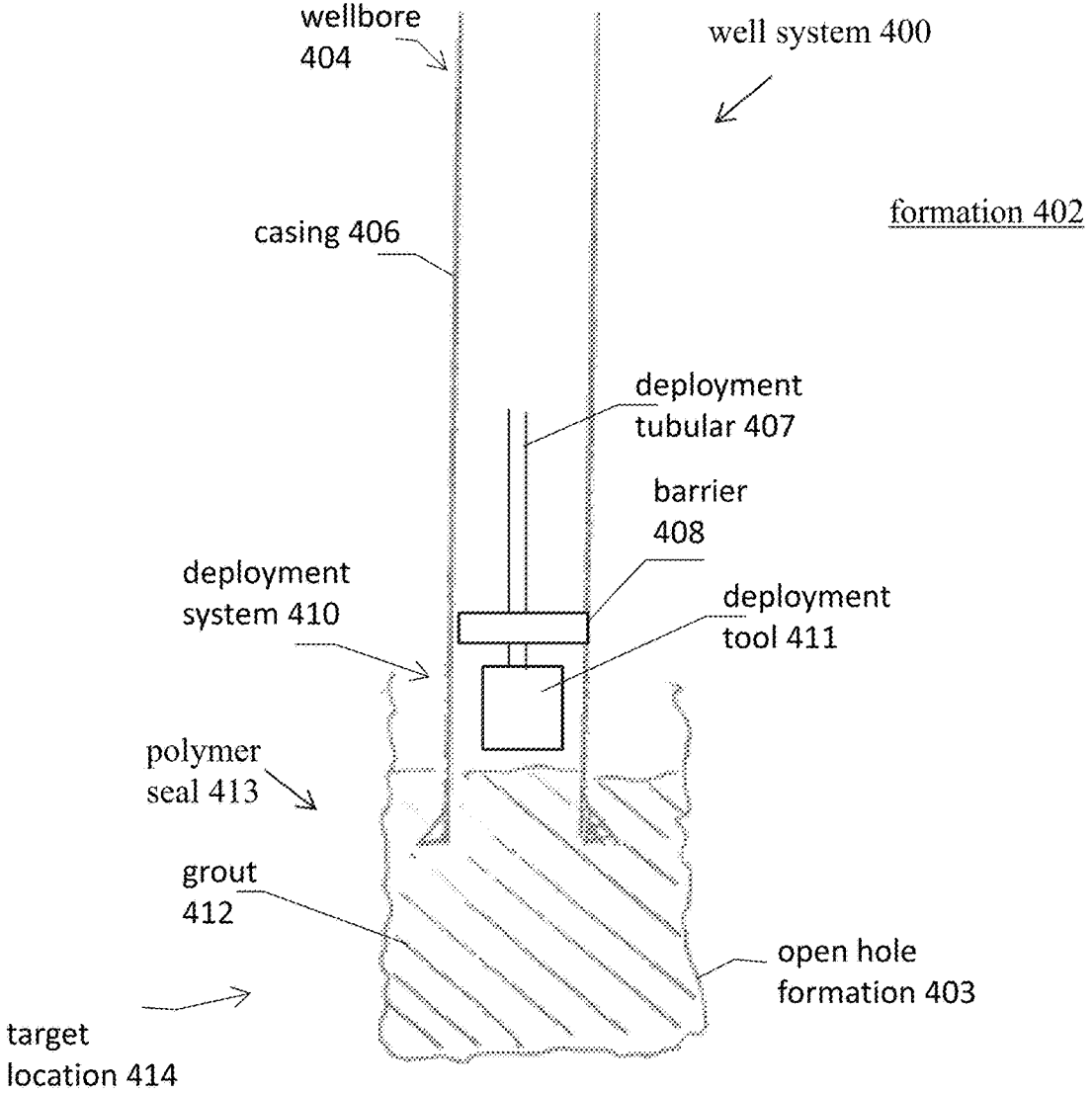
FIG. 4 is a sectional view drawing of a well system in which a polymer seal is placed at a junction of a well and an interval of open hole formation in accordance with the example embodiments described herein.

Referring to FIG. 4, another example well system 400 located in a formation 402 is illustrated. The wellbore 404 is lined with a casing 406 along portions of the wellbore. The bottom portion of the wellbore 404 includes a section to which the casing 406 does not extend leaving the wellbore 404 exposed to the open hole formation 403. As in the previous examples, it is desirable to seal off the wellbore 404 from the formation at the location of the open hole formation 403 at the bottom of the wellbore 404. Accordingly, the area in which the open hole formation 403 is located can be referred to as the target location 414 for placing an expandable polymer grout system.

Similar to the previous examples, a deployment system 410 can be inserted into the wellbore 404 to place expandable polymer grout system 412 at the target location 414 in order to form a polymer seal along the open hole formation 403. A method for sealing the open hole formation 403 with a polymer seal can begin with placing a primary barrier 408 in the wellbore 404 to prevent the expandable polymer grout system 412 from flowing up the cased portion of the wellbore 404. The barrier can be any of a variety of barriers used in well completion including a bridge plug or a packer. However, in other example embodiments, the barrier 408 may be unnecessary and can be omitted.

Next, the deployment system 410 can be inserted into the wellbore 404 through the barrier 408 to the target location 414. As an alternative, the barrier 408 also can be a component of the deployment system 410. As described previously, the deployment system 410 can have a variety of configurations, examples of which are described further below in connection with FIGS. 6A through 8. Generally, the deployment system 410 can include a deployment tubular 407 and a deployment tool 411. The deployment tubular 407 is used to insert the deployment system 410 into the wellbore and, in certain embodiments, the deployment tubular 407 can serve as the conduit through which the expandable polymer grout system 412 passes to reach the target location 214. The deployment tool 411 directs the expandable polymer grout system 412 from the deployment system 410 and into the target location 414 so that it will contact the open hole formation 403. As explained previously and the further examples below, the deployment tool 411 can include one or more of a tail pipe, a mixer, or a cannister.

Once the expandable polymer grout system 412 is delivered to the target location 414, the deployment system 410 can be retracted in the wellbore 404 so that it does not interfere with the curing of the expandable polymer grout system 412. As the expandable polymer grout system 412 cures, it hardens into a polymer seal 413 that seals the formation face at the open hole formation 403.

Figure 5:
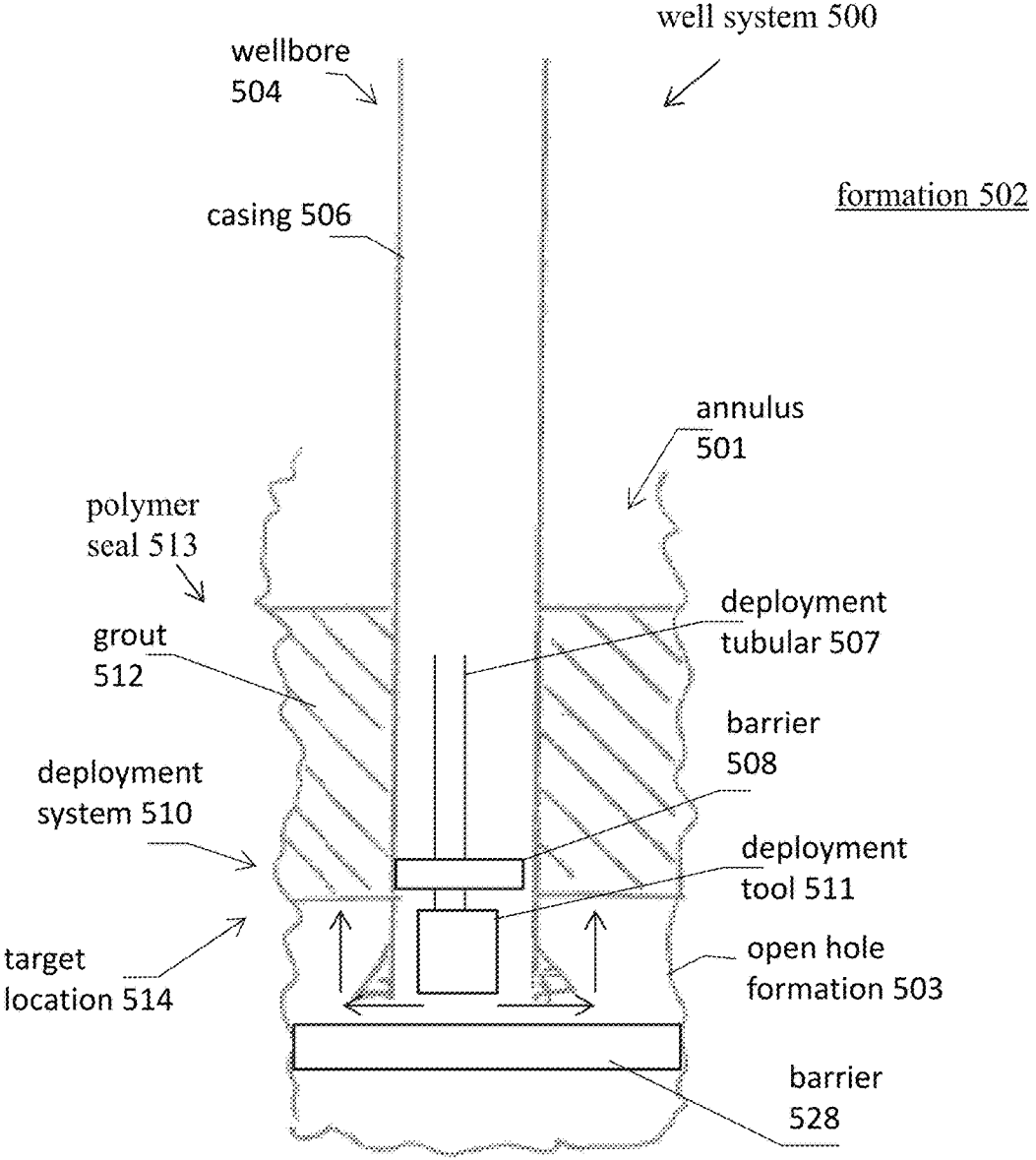
FIG. 5 is a sectional view drawing of another well system in which a polymer seal is injected around the casing annulus at a junction of a well and an interval of open hole formation in accordance with the example embodiments described herein.

Referring now to FIG. 5, another example well system 500 located in a formation 502 is illustrated. The wellbore 504 is lined with a casing 506 along portions of the wellbore. The bottom portion of the wellbore 504 includes a section to which the casing 506 does not extend leaving the wellbore 504 exposed to the open hole formation 503. As in the previous examples, it is desirable to seal off the wellbore 504 from the formation at the location of the open hole formation 503 at the bottom of the wellbore 504. However, in the example well system 500 of FIG. 5, the objective is to seal the casing annulus 501 between the exterior surface of the casing 506 and the open hole formation 503. Accordingly, the casing annulus 501 can be referred to as the target location 514 for placing an expandable polymer grout system.

Similar to the previous examples, a deployment system 510 can be inserted into the wellbore 504 to place expandable polymer grout system 512 at the target location 514 in order to form a polymer seal along the open hole formation 503 in the casing annulus 501. A method for sealing the open hole formation 503 in the casing annulus 501 with a polymer seal can begin with placing a barrier 528 at the bottom of the wellbore 504 below the bottom end of the casing 506. The barrier 528 can be any of a variety of barriers used in well completion including a bridge plug or a packer.

Next, the deployment system 510 can be inserted into the wellbore 504 to the target location 514. As described previously, the deployment system 510 can have a variety of configurations, examples of which are described further below in connection with FIGS. 6A through 8. Generally, the deployment system 510 can include a deployment tubular 507 and a deployment tool 511. The deployment tubular 507 is used to insert the deployment system 510 into the wellbore and, in certain embodiments, the deployment tubular 507 can serve as the conduit through which the expandable polymer grout system 512 passes to reach the target location 514. The deployment tool 511 with isolation provided by the barrier 508 directs the injection of expandable polymer grout system 512 from the deployment system 510 and to the target location 514 so that it will contact the open hole formation 503. As explained previously and the further examples below, the deployment tool 511 can include one or more of a tail pipe, a mixer, or cannisters. The example illustrated in FIG. 5 differs from that of FIG. 4 in that the barrier 528 at the bottom of the wellbore directs the expandable polymer grout system 512 from the deployment tool 511 up into the casing annulus 501.

Once the expandable polymer grout system 512 is delivered to the target location 514 in the casing annulus 501, the deployment system 510 can be retracted in the wellbore 504 so that it does not interfere with the curing of the expandable polymer grout system 512. As the expandable polymer grout system 512 cures, it hardens into a polymer seal 513 that seals the formation face at the open hole formation 503 in the casing annulus 501.

Deployment Systems

As referenced in the previous examples of FIGS. 1 through 5, a deployment system can be used to place the expandable polymer grout system at the desired location in a well system. Further details of example deployment systems will now be described in connection with FIGS. 6A through 8. The reactions between most polyurethane precursors are often so rapid that current methods for mixing, injection downhole, and placement/isolation into a target location at a low rate of injection (such as bull-heading and/or cement-squeeze applications) are insufficient to mitigate the risks of this rapid reactivity. For example, if two polyurethane precursors were blended through batch mixing on the surface of the well system and pumped down the wellbore using conventional low-rate pumps (such as cement pumps), the grout expansion would likely initiate before or during conveyance downhole. Additionally, with the expected pump times at low rates of injection, the expanded grout would likely cure into a solid in the workstring or casing before reaching the target location. Accordingly, the following examples of deployment systems are directed to placing the expandable polymer grout system at the desired location and within the required time to allow the expandable polymer grout system to cure into the polymer seal at the desired location.

Figure 6A:
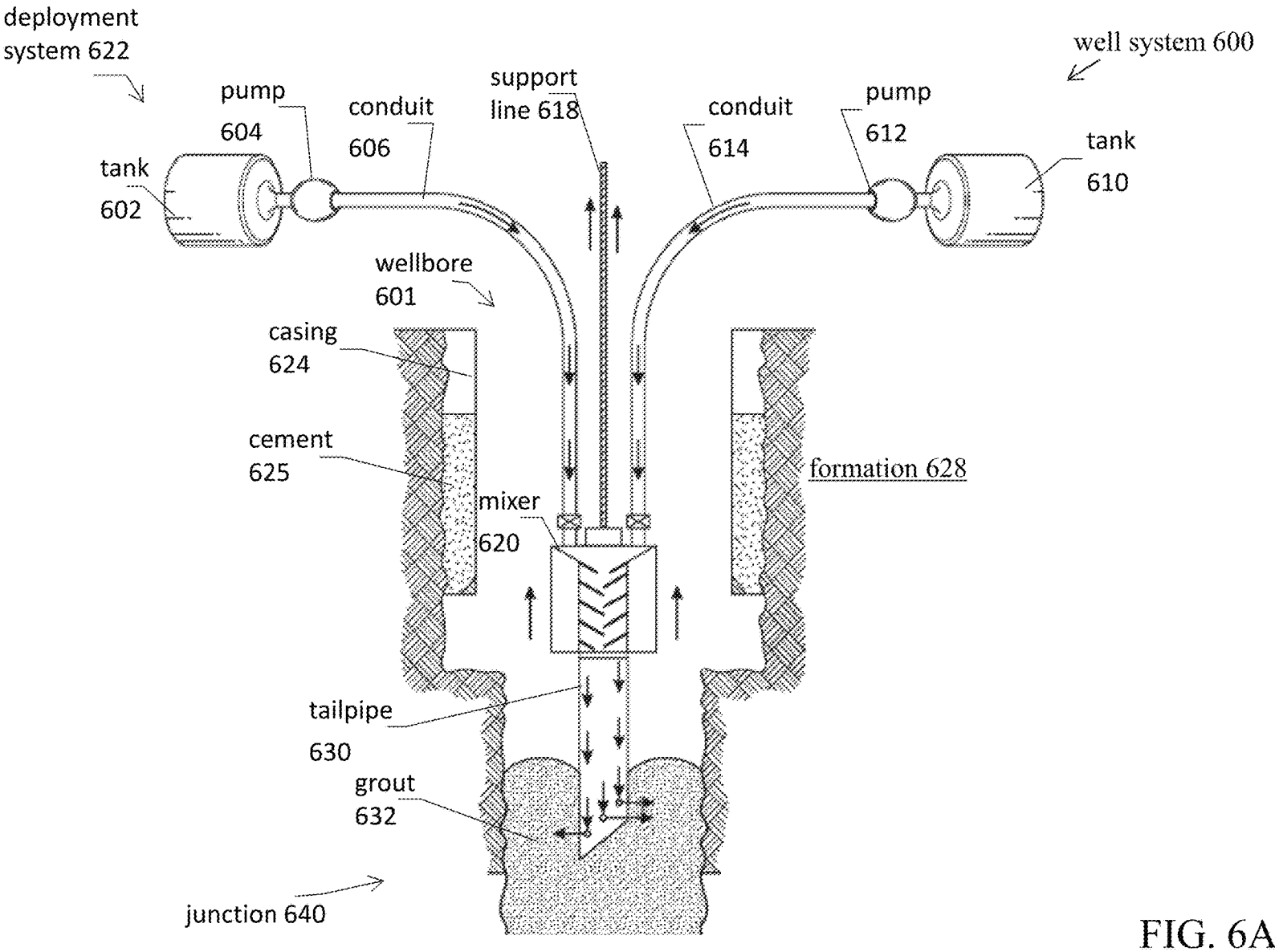
FIG. 6A is a sectional view drawing of a system for deploying an expandable polymer grout system in accordance with the example embodiments described herein.
Figure 6B:
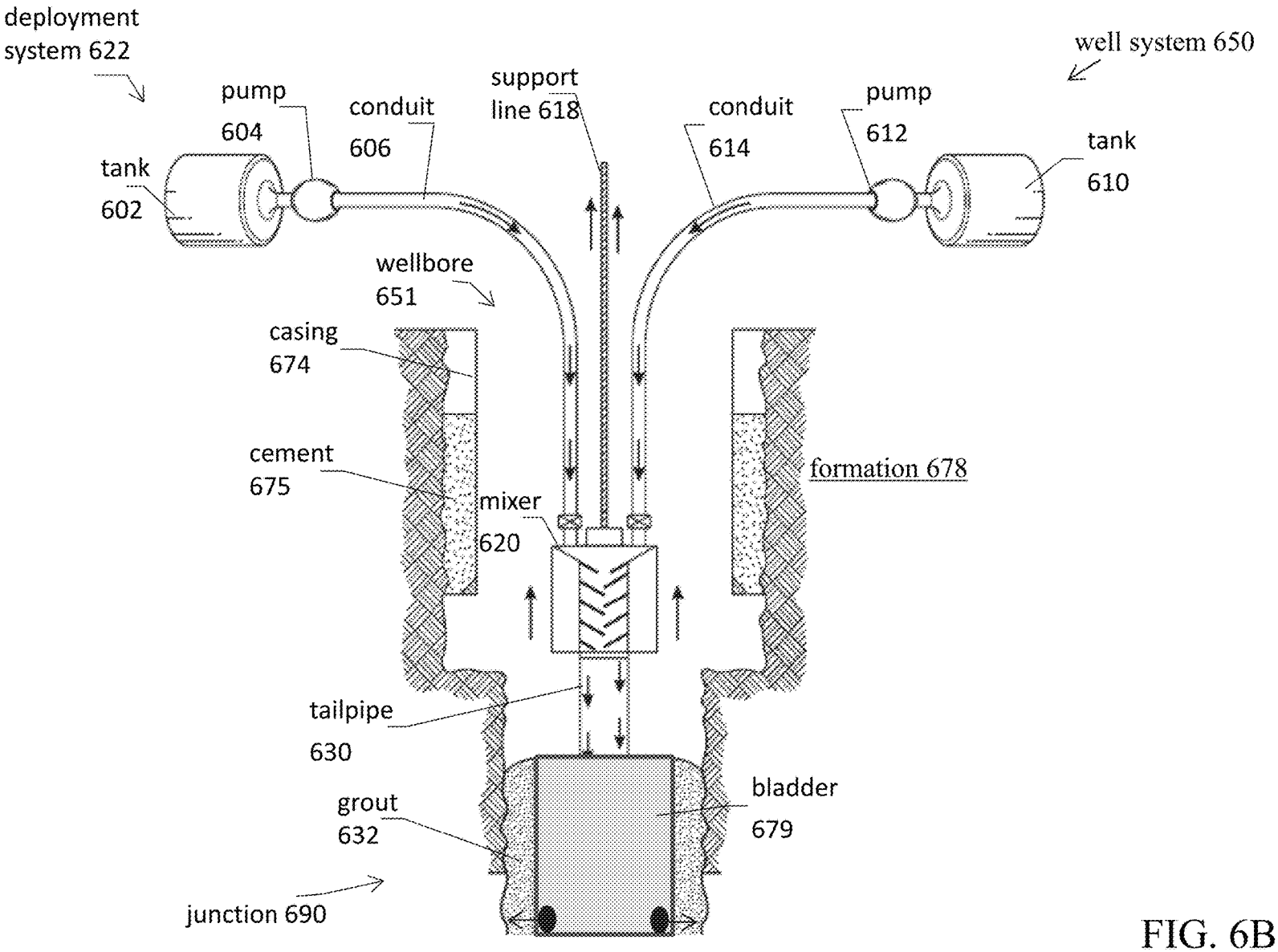
FIG. 6B is a sectional view drawing of another system for deploying an expandable polymer grout system in accordance with the example embodiments described herein.

Referring to FIG. 6A, an example well system 600 comprising a wellbore 601 in a formation 628 is illustrated. The wellbore includes a casing 624 and cement 625 sealing an upper portion of the wellbore. The wellbore 601 also has a lower portion that is an open hole section at a target location where the face of the formation 628 is exposed to the wellbore 601. Also illustrated is an example deployment system 622 for deploying an expandable polymer grout system at the target location within a wellbore 651. The target location can be a junction 640 of two wellbores as illustrated in FIGS. 1A-3, a location at a bottom of a wellbore as illustrated in FIGS. 4-5, or another subterranean location with an exposed formation face that is to be sealed. The example deployment system of FIG. 6A includes a first conduit 606 that delivers an isocyanate component through a wellbore 601 to a mixer 620. The isocyanate flows from a tank 602 and is pumped via a pump 604 through the first conduit 606. A check valve at the end of the first conduit 606 controls the flow of the isocyanate into the mixer 620. The example system of FIG. 6A also includes a second conduit 614 that delivers an organic polyol component through the wellbore 601 to the mixer 620. The organic polyol component flows from a tank 610 and is pumped via a pump 612 through the second conduit 614. While the first conduit 606 and second conduit 614 are illustrated as separated components in FIG. 6A, in other examples they may be combined into a single tubular and may be concentrically aligned. A check valve at the end of the second conduit 614 controls the flow of the organic polyol component into the mixer 620. As explained previously, the organic polyol component may be pre-blended with blowing agents, catalysts, and other auxiliary components before the component it pumped into the wellbore via pump 612. The tanks 602 and 610 can be stationary tanks located at the surface of the well system 600 or can be mobile tanks mounted on vehicles.

In certain example embodiments, the mixer 620 with the attached first conduit 606 and attached second conduit 614 can be raised and lowered into the wellbore by an optional support line 618 or on a tubular string. In the example illustrated in FIG. 6A, the mixer 620 is a static mixer with helical internal surfaces that mix the isocyanate component and the organic polyol component as they flow into the mixer 620 from the first conduit 606 and the second conduit 614. As the isocyanate component and the organic polyol component combine within the mixer, they react and form the expandable polymer grout system 632. The mixed components of the expandable polymer grout system 632 exit the mixer 620 through an outlet at the bottom of the mixer 620 and flow into a tailpipe 630 attached to the bottom of the mixer 620. As illustrated in the example of FIG. 6A, the tailpipe 630 preferably has a tapered bottom that assists in minimizing the likelihood that the tailpipe will become stuck on other equipment as it is lowered with the mixer into the wellbore. The mixture of the expandable polymer grout system 632 flows into the tailpipe 630 and apertures in the tailpipe direct the flowing mixture to a target location. In the example of FIG. 6A, the bottom of the tailpipe 630 is closed and the apertures are located in a sidewall of the tailpipe 630 to facilitate flow of the mixture out of the tailpipe 630, however, in other embodiments, the apertures can be located at other positions on the tailpipe. The shape of the tailpipe and the positions of the apertures can be selected to accurately direct the mixture to the desired target location.

An advantage of the deployment system 622 illustrated in FIG. 6A is that the expandable polymer grout system components are mixed proximate to the target location and flow to the target location before the expandable polymer grout system 632 cures and forms a hardened polymer seal along the open hole formation. As non-limiting examples, it is preferred that the components of the expandable polymer grout system are mixed within the wellbore and within a distance of 50 feet from the target location, more preferably within 40 feet of the target location, and still more preferably within 30 feet of the target location. The components of FIG. 6A are not drawn to scale. Nonetheless, as one example, the height of the mixer 620 can be between 8 and 20 inches and the height of the tailpipe 630 can be between 5 feet and 30 feet. Taking into account these typical dimensions and the speed of the pumps 604 and 612, the mixture can be combined at the mixer 620 and flow through the tailpipe 630 to the target location within a few minutes so that the grout is in the desired position before it hardens.

As the expandable polymer grout system 632 flows out of the tailpipe 630 to the target location, the support line 618 can be used to retract the mixer 620 and the attached tailpipe 630 and conduits 606, 614 from the wellbore 601. The rate at which the components are pumped through the conduits can be equal to the rate at which the mixer 620 and its attached components are retracted from the wellbore so that the mixer 620 and tailpipe 630 maintain a generally uniform distance from the target location as the expandable polymer grout accumulates in the target location.

Referring to FIG. 6B, the deployment system 622 of FIG. 6A is illustrated again in a different well system 650. Well system 650 is similar to well system 600 of FIG. 6A in that it comprises a wellbore 651 in a formation 678. The wellbore includes a casing 674 and cement 675 sealing an upper portion of the wellbore. The wellbore 651 also has a lower portion that is an open hole section at a junction 690 (or more generally, a target location) of two wellbores.

The deployment system 622 shown in FIG. 6B generally has the same components as the deployment system illustrated in FIG. 6A. Accordingly, the previous description of those same components applies to the example of FIG. 6B and will not be repeated. However, deployment system 622 of FIG. 6B has been modified to include a bladder 679. As illustrated in FIG. 6B, the bladder can be expanded when located in the junction 690 so that the expandable polymer grout system 632 exiting the deployment system 622 is pushed to the outer perimeter of the wellbore 651 and against the open hole formation. After the expandable polymer grout system 632 cures to become a hardened polymer seal along the open hole formation portion of the wellbore 651, the bladder 679 can be deflated and the deployment system 622 can be retracted from the wellbore 651. Accordingly, unlike some of the other embodiments described herein, the deployment system 622 is not immediately retracted after deploying the expandable polymer grout system. Instead, the deployment system 622 remains in place with the bladder 679 expanded to provide time for the expandable polymer grout system 632 to cure into the hardened polymer seal.

Once the polymer seal is formed and the bladder and the deployment system 622 are retracted, a conduit through the center of the polymer seal remains where the expanded bladder 679 was previously positioned. The conduit allows access to the farther portions of the wellbore 651 beyond the polymer seal. While a bladder is used in the example illustrated in FIG. 6B, in other embodiments, other types of tools can be used that can be actuated to expand and retract in the center of the wellbore in order to form the conduit.

Figure 7:
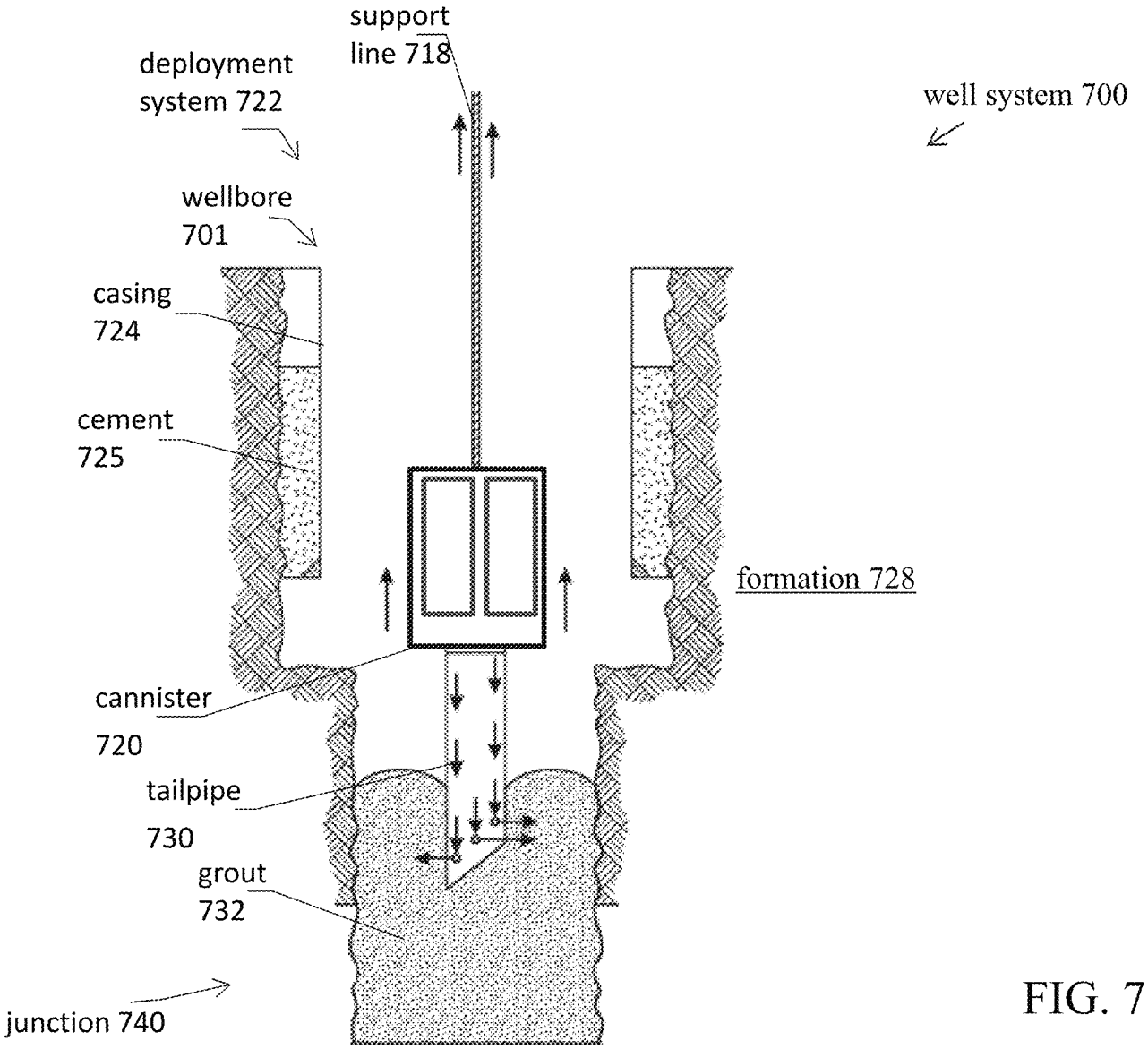
FIG. 7 is a sectional view drawing of yet another system for deploying an expandable polymer grout system in accordance with the example embodiments described herein.

Referring now to FIG. 7, an example well system 700 comprising a wellbore 701 in a formation 728 is illustrated. The wellbore includes a casing 724 and cement 725 sealing an upper portion of the wellbore. The wellbore 601 also has a lower portion that is an open hole section at a target location where the face of the formation 728 is exposed to the wellbore 701. Also illustrated is an example deployment system 722 for deploying an expandable polymer grout system at the target location within a wellbore 701. The target location can be a junction 740 of two wellbores as illustrated in FIGS. 1-3, a location at a bottom of a wellbore as illustrated in FIGS. 4-5, or another subterranean location with an exposed formation face that is to be sealed. The example deployment system 722 of FIG. 7 includes a cannister 720 that can be lowered into and raised from the junction 740 by a support line 718 or a tubular string. The cannister comprises a first compartment containing an isocyanate component and a second compartment containing an organic polyol component. As explained previously, the organic polyol component may be pre-blended with blowing agents, catalysts, and other auxiliary components.

At the time of deployment, the cannister 720 can be actuated to combine the isocyanate component and the organic polyol component, which components react and form the expandable polymer grout system 732. The actuation of the cannister can be triggered, for example, by a slickline or e-line extending down into the wellbore, by a mechanical trigger and timer, or by a change in pressure. The mixed components of the expandable polymer grout system 732 exit the cannister 720 through an outlet at the bottom of the cannister 720 and flow into a tailpipe 730 attached to the bottom of the cannister 720. In certain embodiments, the cannister can include a pressurized fluid that applies pressure to the expandable polymer grout system 732 encouraging it to exit the cannister 720. The mixture of the expandable polymer grout system 732 flows through the tailpipe 730 and apertures in the tailpipe direct the flowing mixture to a target location.

An advantage of the deployment system 722 illustrated in FIG. 7 is that the expandable polymer grout system components are mixed proximate to the target location (the junction 740) and flow to the target location before the expandable polymer grout system 732 cures and forms a hardened polymer seal along the open hole formation.

Figure 8:
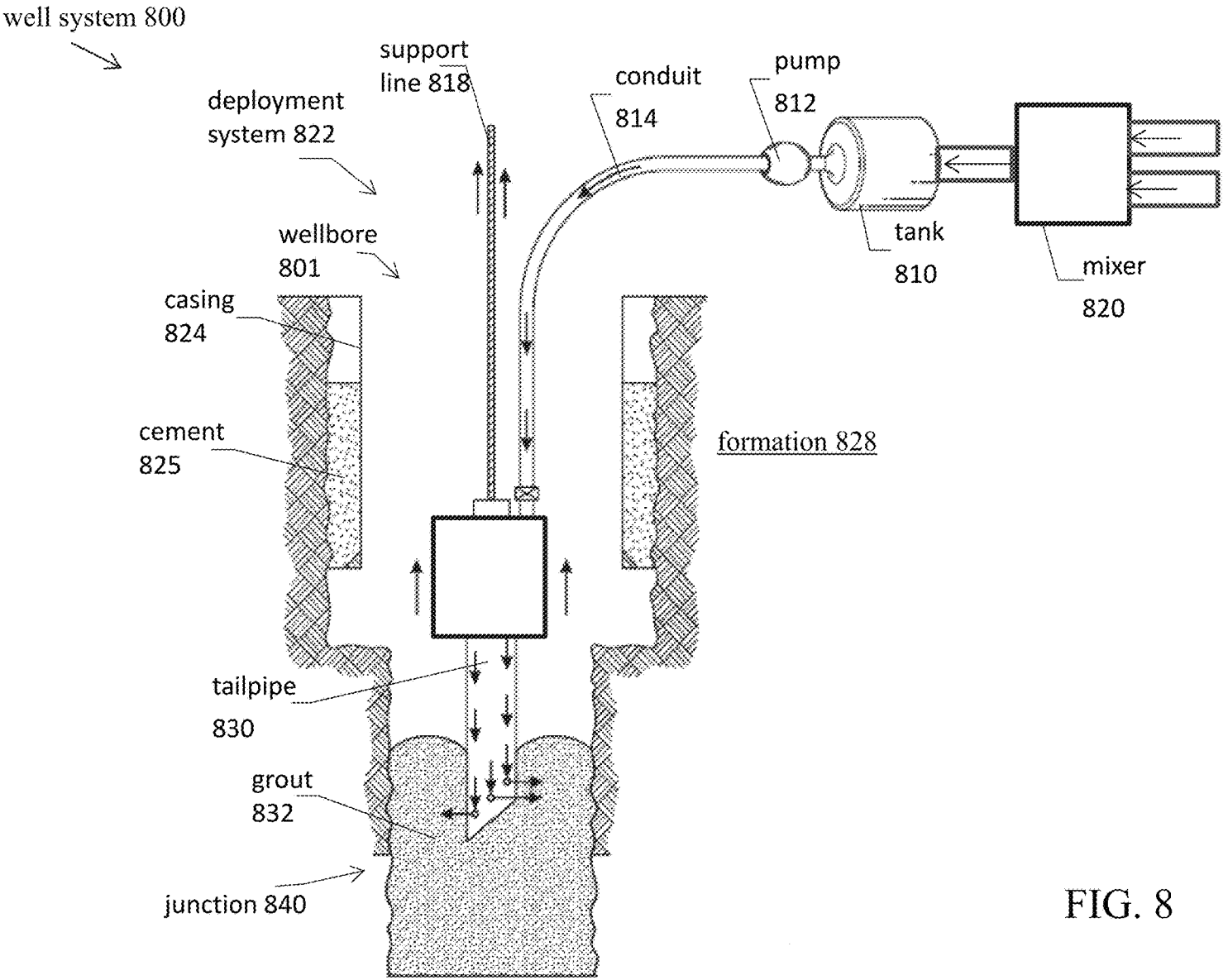
FIG. 8 is a sectional view drawing of yet another system for deploying an expandable polymer grout system in accordance with the example embodiments described herein.

Referring now to FIG. 8, an example well system 800 comprising a wellbore 801 in a formation 828 is illustrated. The wellbore includes a casing 824 and cement 825 sealing an upper portion of the wellbore. The wellbore 801 also has a lower portion that is an open hole section at a target location where the face of the formation 828 is exposed to the wellbore 801. Also illustrated is an example deployment system 822 for deploying an expandable polymer grout system at the target location within a wellbore 801. The target location can be a junction 840 of two wellbores as illustrated in FIGS. 1-3, a location at a bottom of a wellbore as illustrated in FIGS. 4-5, or another subterranean location with an exposed formation face that is to be sealed.

The example deployment system 822 of FIG. 8 differs from the previous deployment systems in that the isocyanate component and the organic polyol component are mixed in a mixer 820 located at the surface of the well system. As explained previously, the organic polyol component may be pre-blended with blowing agents, catalysts, and other auxiliary components. The example of FIG. 8 may be appropriate for an expandable polymer grout system that requires more time to cure into a hardened polymer seal.

At the time of deployment, the mixer 820 can combine the isocyanate component and the organic polyol component, which components react and form the expandable polymer grout system 832. The mixed components of the expandable polymer grout system 832 can be directed from the mixer 820 to an optional tank 810 and then to a pump 812 that directs the mixture down a conduit 814. A bottom portion of the deployment system 822 can be lowered into and raised from the wellbore 801 by a support line 818 or a tubular string. At the base of the deployment system 822, the expandable polymer grout system 832 flows into a tailpipe 830 and exits through apertures in the tailpipe that direct the flowing mixture to a target location (the junction 840). Once in the junction 840, the expandable polymer grout system 832 cures into the hardened polymer seal that seals the walls of the open hole formation.

Although embodiments described herein are made with reference to the examples illustrated in the figures, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

We claim:

1. A method for placing a polymer seal in a well system, the method comprising:

placing a primary barrier across a primary casing in a primary wellbore;

placing a secondary barrier across a secondary casing in a secondary wellbore;

inserting a deployment system to a junction in the well system, the junction formed by an intersection of the primary wellbore and the secondary wellbore, wherein the junction is located above the primary barrier and the secondary barrier and the junction comprises an open hole formation surface;

delivering with the deployment system an expandable polymer grout system to the junction, wherein the expandable polymer grout system comprises an isocyanate component, an organic polyol component, and a blowing agent;

retracting the deployment system from the junction; and allowing the expandable polymer grout system to cure to form the polymer seal at the junction.

2. The method of claim 1, further comprising: drilling a conduit through a center of the polymer seal while leaving a perimeter of the polymer seal attached to the open hole formation surface.

3. The method of claim 1, further comprising: expanding a bladder of the deployment system before delivering with the deployment system the expandable polymer grout system to the junction.

4. The method of claim 3, further comprising: retracting the bladder of the deployment system after allowing the expandable polymer grout system to cure to form the polymer seal at the junction, wherein retracting the bladder leaves a conduit through a center of the polymer seal.

5. The method of claim 1, wherein the isocyanate component and the organic polyol component of the expandable polymer grout system are mixed within the deployment system after inserting the deployment system to the junction in the well system.

6. The method of claim 5, wherein the isocyanate component and the organic polyol component of the expandable polymer grout system are mixed within a mixer of the deployment system.

7. The method of claim 5, wherein the isocyanate component and the organic polyol component of the expandable polymer grout system are mixed within a cannister of the deployment system.

8. The method of claim 1, wherein the isocyanate component and the organic polyol component of the expandable polymer grout system are mixed at a surface of the well system before being delivered with the deployment system to the junction.

9. A method for placing a polymer seal in a well system, the method comprising:

placing a primary barrier across a primary casing in a primary wellbore;

placing a secondary barrier across a secondary casing in a secondary wellbore, wherein the primary wellbore and the secondary wellbore intersect and are aligned at a junction, wherein the junction is located adjacent to the primary barrier and the secondary barrier;

inserting a deployment system to the junction in the well system, wherein the junction comprises an open hole formation surface;

delivering with the deployment system an expandable polymer grout system to the junction, wherein the expandable polymer grout system comprises an isocyanate component, an organic polyol component, and a blowing agent;

retracting the deployment system from the junction; and allowing the expandable polymer grout system to cure to form the polymer seal at the junction.

10. The method of claim 9, further comprising: drilling a conduit through a center of the polymer seal while leaving a perimeter of the polymer seal attached to the open hole formation surface.

11. The method of claim 9, further comprising: expanding a bladder of the deployment system before delivering with the deployment system the expandable polymer grout system to the junction.

12. The method of claim 11, retracting the bladder of the deployment system after allowing the expandable polymer grout system to cure to form the polymer seal at the junction, wherein retracting the bladder leaves a conduit through a center of the polymer seal.

13. The method of claim 9, wherein the isocyanate component and the organic polyol component of the expandable polymer grout system are mixed within the deployment system after inserting the deployment system to the junction in the well system.

14. The method of claim 13, wherein the isocyanate component and the organic polyol component of the expandable polymer grout system are mixed within a mixer of the deployment system.

15. The method of claim 13, wherein the isocyanate component and the organic polyol component of the expandable polymer grout system are mixed within a cannister of the deployment system.

16. The method of claim 9, wherein the isocyanate component and the organic polyol component of the expandable polymer grout system are mixed at a surface of the well system before being delivered with the deployment system to the junction.

* * * * *